US011982140B2

(12) United States Patent
Mikalsen

(10) Patent No.: US 11,982,140 B2
(45) Date of Patent: May 14, 2024

(54) DOPING DEVICES FOR APPLYING DOPE TO PIPE THREADS

(71) Applicant: Canrig Robotic Technologies AS, Sandnes (NO)

(72) Inventor: Kenneth Mikalsen, Sandnes (NO)

(73) Assignee: Canrig Robotic Technologies AS, Sandnes (NO)

( * ) Notice: Subject to any disclaimer, the term of this patent is extended or adjusted under 35 U.S.C. 154(b) by 271 days.

(21) Appl. No.: 17/008,097

(22) Filed: Aug. 31, 2020

(65) Prior Publication Data

US 2021/0071485 A1 Mar. 11, 2021

Related U.S. Application Data

(60) Provisional application No. 62/896,828, filed on Sep. 6, 2019.

(51) Int. Cl.
*E21B 19/16* (2006.01)
*E21B 17/042* (2006.01)

(52) U.S. Cl.
CPC ..... *E21B 19/16* (2013.01); *E21B 17/042* (2013.01)

(58) Field of Classification Search
None
See application file for complete search history.

(56) References Cited

U.S. PATENT DOCUMENTS 4,397,605 A * 8/1983 Cowgill ..... E21B 19/14 294/203
5,857,476 A * 1/1999 Bee ..... E21B 12/06 134/167 C
6,179,065 B1 1/2001 Payne et al.
6,589,343 B1 7/2003 Egeland
7,132,127 B2 * 11/2006 Belik ..... E21B 17/006 427/236
7,963,371 B2 * 6/2011 Belik ..... F16N 7/32 118/712
8,025,024 B2 * 9/2011 Halse ..... E21B 17/006 118/313
8,439,128 B2 5/2013 Vatne
9,493,996 B2 * 11/2016 Lavalley ..... E21B 19/163
11,767,719 B2 * 9/2023 Naesgaard ..... E21B 19/155 414/22.55

(Continued)

FOREIGN PATENT DOCUMENTS

CA 2513643 C 6/2009
EP 1825186 B1 5/2011

(Continued)

OTHER PUBLICATIONS

International Search Report for PCT/EP2020/074463, dated Oct. 30, 2020, 4 pages.

*Primary Examiner* — Matthew Troutman
*Assistant Examiner* — Douglas S Wood
(74) *Attorney, Agent, or Firm* — Abel Schillinger, LLP

(57) ABSTRACT

A system for conducting a subterranean operation with nozzle of a doping device rotationally fixed to a rig with the nozzle being directed radially toward a portion of a tubular when the portion of the tubular is positioned proximate the doping device, with the doping device, via the nozzle, configured to apply a dope to the portion of the tubular, where the nozzle deposits a layer of the dope on the portion of the tubular while the tubular is being rotated.

1 Claim, 25 Drawing Sheets

(56) References Cited

U.S. PATENT DOCUMENTS

| | | | | |
|---|---|---|---|---|
| 2004/0026080 | A1 | 2/2004 | Reinholdt et al. | |
| 2007/0079671 | A1* | 4/2007 | Halse | E21B 19/164 81/57.35 |
| 2008/0223418 | A1* | 9/2008 | Vatne | E21B 17/006 134/115 R |
| 2009/0211405 | A1* | 8/2009 | Hunter | E21B 19/163 81/57.2 |
| 2012/0034376 | A1* | 2/2012 | Nakamura | B05B 13/0442 427/233 |
| 2016/0047180 | A1* | 2/2016 | Belik | E21B 47/12 166/77.52 |
| 2016/0059279 | A1* | 3/2016 | Belik | B08B 9/021 134/169 C |
| 2017/0328149 | A1 | 11/2017 | Søyland et al. | |
| 2018/0128065 | A1* | 5/2018 | Gupta | E21B 19/15 |
| 2018/0142523 | A1* | 5/2018 | Hackl | B08B 1/12 |
| 2019/0134659 | A1* | 5/2019 | Schanlaub | B05D 1/28 |
| 2019/0136669 | A1 | 5/2019 | Wiedecke et al. | |
| 2020/0199949 | A1* | 6/2020 | Magnuson | E21B 15/00 |
| 2022/0186571 | A1* | 6/2022 | Lien | E21B 19/16 |

FOREIGN PATENT DOCUMENTS

| | | | |
|---|---|---|---|
| NL | 8800247 | A | 9/1989 |
| WO | 9960245 | A1 | 11/1999 |
| WO | 2006/065149 | A1 | 6/2006 |
| WO | 2007/037698 | A1 | 4/2007 |
| WO | 2012115523 | A1 | 8/2012 |
| WO | 2013115523 | A1 | 8/2012 |

* cited by examiner

| | JAA 1/8" | JBA 1/4" | JCA 3/8" | Capacity code | D mm | Capacity at different pressure values (l/min) (bar) | | | | | | | | |
|---|---|---|---|---|---|---|---|---|---|---|---|---|---|---|
| | | | | | | 0.5 | 1.0 | 2.0 | 3.0 | 4.0 | 5.0 | 7.0 | 10 | 20 |
| 0° | • | • | | 1153 | 1.25 | 0.62 | 0.88 | 1.25 | 1.53 | 1.77 | 1.98 | 2.34 | 2.79 | 3.95 |
| | • | • | | 1190 | 1.30 | 0.78 | 1.10 | 1.55 | 1.90 | 2.19 | 2.45 | 2.90 | 3.47 | 4.91 |
| | • | • | | 1233 | 1.50 | 0.95 | 1.35 | 1.90 | 2.33 | 2.69 | 3.01 | 3.56 | 4.25 | 6.02 |
| | • | • | | 1310 | 1.70 | 1.27 | 1.79 | 2.53 | 3.10 | 3.58 | 4.00 | 4.74 | 5.66 | 8.00 |
| | • | • | | 1385 | 1.80 | 1.57 | 2.22 | 3.14 | 3.85 | 4.45 | 4.97 | 5.88 | 7.03 | 9.94 |
| | • | • | | 1490 | 2.10 | 2.00 | 2.83 | 4.00 | 4.90 | 5.66 | 6.33 | 7.48 | 8.95 | 12.7 |
| | • | • | | 1581 | 2.30 | 2.37 | 3.35 | 4.74 | 5.81 | 6.71 | 7.50 | 8.87 | 10.6 | 15.0 |
| | • | • | • | 1780 | 2.70 | 3.18 | 4.50 | 6.37 | 7.80 | 9.01 | 10.1 | 11.9 | 14.2 | 20.1 |
| | • | • | • | 1980 | 3.00 | 4.00 | 5.66 | 8.00 | 9.80 | 11.3 | 12.7 | 15.0 | 17.9 | 25.3 |
| | • | • | • | 2124 | 3.40 | 5.06 | 7.16 | 10.1 | 12.4 | 14.3 | 16.0 | 18.9 | 22.6 | 32.0 |
| | • | • | • | 2153 | 3.80 | 6.25 | 8.83 | 12.5 | 15.3 | 17.7 | 19.8 | 23.4 | 27.9 | 39.5 |
| | | • | • | 2195 | 4.30 | 7.96 | 11.3 | 15.9 | 19.5 | 22.5 | 25.2 | 29.8 | 35.6 | 50.3 |
| | | • | • | 2245 | 4.80 | 10.0 | 14.1 | 20.0 | 24.5 | 28.3 | 31.6 | 37.4 | 44.7 | 63.3 |
| | | • | • | 2274 | 5.20 | 11.2 | 15.8 | 22.4 | 27.4 | 31.6 | 35.4 | 41.9 | 50.0 | 70.7 |
| | | • | • | 2310 | 5.40 | 12.7 | 17.9 | 25.3 | 31.0 | 35.8 | 40.0 | 47.4 | 56.6 | 80.0 |
| | | • | • | 2390 | 6.00 | 15.9 | 22.5 | 31.8 | 39.0 | 45.0 | 50.3 | 59.6 | 71.2 | 101 |
| | | • | • | 2470 | 6.20 | 19.2 | 27.1 | 38.4 | 47.0 | 54.3 | 60.7 | 71.8 | 85.8 | 121 |

SPRAY ANGLE CODES

| JBA | JBC | JBF | JBM | JBQ | JBU | JBW |
|---|---|---|---|---|---|---|
| 0° | 20° | 30° | 45° | 60° | 90° | 120° |

THREAD SIZE CODES (RG)

| JA | JB | JC |
|---|---|---|
| 1/8" | 1/4" | 3/8" |

DIMENSIONS AND WEIGHTS

| Code unit | Size (RG) inch | H mm | H1 mm | WS mm | W gram |
|---|---|---|---|---|---|
| JA | 1/8" | 19.5 | 11 | 12 | 9 |
| JB | 1/4" | 22.0 | 12 | 14 | 18 |
| JC | 3/8" | 25.0 | 14 | 17 | 34 |

SECTION 12-12

SECTION 11-11

SECTION LINE 16-16

SECTION LINE 17-17

SECTION LINE 17-17

DOPING DEVICES FOR APPLYING DOPE TO PIPE THREADS

CROSS-REFERENCE TO RELATED APPLICATION(S)

This application claims priority under 35 U.S.C. § 119(e) to U.S. Patent Application No. 62/896,828, entitled "DOPING DEVICES FOR APPLYING DOPE TO PIPE THREADS," by Kenneth MIKALSEN, filed Sep. 6, 2019, which application is assigned to the current assignee hereof and incorporated herein by reference in its entirety.

BACKGROUND

Embodiments of the present disclosure relate generally to the field of drilling and processing of wells. More particularly, present embodiments relate to a system and method for operating robotic systems during subterranean operations to apply dope to threads on tubulars.

Robots can assist operators when performing subterranean operations, such as drilling wellbores, casing wellbores, wellbore testing, etc. that may utilize a segmented tubular string extending in the wellbore. The robots, such as pipe handlers, can handle tubulars to present the tubulars to a well center of a rig for connection to a tubular string (such as when the tubular string is being tripped into the wellbore) or handle tubulars to retrieve them from the well center of the rig when connections to the tubular string are broken (such as when the tubular string is being tripped out of the wellbore). As connections are made or broken, the robots may assist the operators in cleaning and applying dope to the threads in preparation for the next time the tubulars are connected to the tubular string.

If too little dope is applied to the tubular threads and a connection shoulder of the tubular end, then the connection to the tubular string may not protect the threads as desired and can possibly make it more difficult to break the connection when needed. If too much dope is applied to the tubular threads and a connection shoulder of the tubular end, then it may take longer to tighten the connection of the tubular to the tubular string because the excess dope must be squeezed from the connection as the connection is being made. This also can result in wasting dope. Therefore, if a correct amount of dope is applied to the threads and a connection shoulder (hereafter referred to as a shoulder) of the tubular end, then these issues can be avoided. Therefore, improvements in robotic systems for pipe handling and dope application are continually needed.

SUMMARY

In accordance with an aspect of the disclosure, a system for conducting a subterranean operation, that can include a doping device configured to apply a fluid to the threads and shoulders of an end of a tubular, where the doping device forms a layer of the fluid on the threads and shoulders of the end of the tubular, with the layer having an average thickness measured over an area of the layer, with the area being at least 25% of a circumference of the threads and shoulders of the end of the tubular and along an axial length of at least 10 mm of the threads and shoulders of the end of the tubular. Thickness variations of the layer within the area can be less than 20% of the average thickness of the layer across the area. Also, the average thickness of the layer across the area can be less than 3 mm, or less than 2.5 mm, or less than 2.0 mm, or less than 1.5 mm, or less than 1.0 mm, or less than 0.5 mm, or less than 0.4 mm, or less than 0.3 mm, or less than 0.2 mm, or less than 0.15 mm, or less than 0.12 mm. The doping device is configured to accommodate various types of tubulars as well as various sizes of the various types. The larger size tubulars, such as casing, as well as the smaller size tubulars, such as smaller diameter drill pipe, can be cleaned and doped by the doping device, without adjusting the positions of the nozzles in the doping device. This is applicable to both the pin end and box end doping devices.

In accordance with another aspect of the disclosure, a system for doping threads of a tubular in a subterranean operation can include a doping device configured to apply fluid to the threads and shoulders of an end of the tubular as the tubular is rotated relative to the doping device, the doping device comprising a nozzle operated at an elevated pressure which forces the fluid through the nozzle and sprays the fluid on the threads and shoulders of the end of the tubular, where the elevated pressure can be less than 200 bar (2901 psi) and greater than 2 bar (29 psi), or less than 150 bar (2176 psi) and greater than 2 bar (29 psi), or less than 140 bar (2031 psi) and greater than 3 bar (44 psi), or less than 140 bar (2031 psi) and greater than 3.85 bar (56 psi), or less than 140 bar (2031 psi) and greater than 4 bar (58 psi), or less than 140 bar (2031 psi) and greater than 5 bar (73 psi), or less than 140 bar (2031 psi) and greater than 8 bar (116 psi), or less than 140 bar (2031 psi) and greater than 10 bar (145 psi), or less than 135 bar (2031 psi) and greater than 110 bar (1595 psi), or less than 130 bar (1885 psi) and greater than 120 bar (1740 psi).

In accordance with another aspect of the disclosure, a method for conducting a subterranean operation can include operations of mounting a doping device with a plurality of nozzles to a rig, such that the plurality of nozzles is rotationally fixed to the rig, rotating, via a pipe handler, a tubular relative to the plurality of nozzles and the rig, and spraying a fluid on the threads and shoulders of an end of the tubular while the tubular is rotating. The fluid can be an air/dope mixture, where the spraying further comprises forming a layer of dope on the threads and shoulders of the end of the tubular, with the layer having an average thickness measured over an area of the layer, with the area being at least 25% of a circumference of the portion of the threads and along an axial length of at least 10 mm of the portion of the threads. The doping device can include a housing with the plurality of nozzles mounted to the housing, and the method can further include operations of positioning, via the pipe handler, the end of the tubular into the housing, pressurizing the fluid to a pressure of less than 200 bar (2901 psi) and greater than 2 bar (29 psi), and spraying the fluid from at least one of the plurality of nozzles on the threads and shoulders of the end when the at least one of the plurality of nozzles is enabled.

BRIEF DESCRIPTION OF THE DRAWINGS

These and other features, aspects, and advantages of present embodiments will become better understood when the following detailed description is read with reference to the accompanying drawings in which like characters represent like parts throughout the drawings, wherein.

DETAILED DESCRIPTION

Present embodiments provide a robotic system that can include a doping device with electrical components that can operate in hazardous zones (such as a rig floor) during subterranean operations. The robotic system can include a doping device and a sealed housing, with electrical equipment and/or components contained within the sealed housing. The aspects of various embodiments are described in more detail below.

As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive- or and not to an exclusive-or. For example, a condition A or B is satisfied by any one of the following: A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise.

The use of the word "about", "approximately", or "substantially" is intended, unless otherwise specified, to mean that a value of a parameter is close to a stated value or position. However, minor differences may prevent the values or positions from being exactly as stated. Thus, differences of up to and including ten percent (10%) for the value are reasonable differences from the ideal goal of exactly as described. A significant difference can be when the difference is greater than ten percent (10%).

Figure 1A:
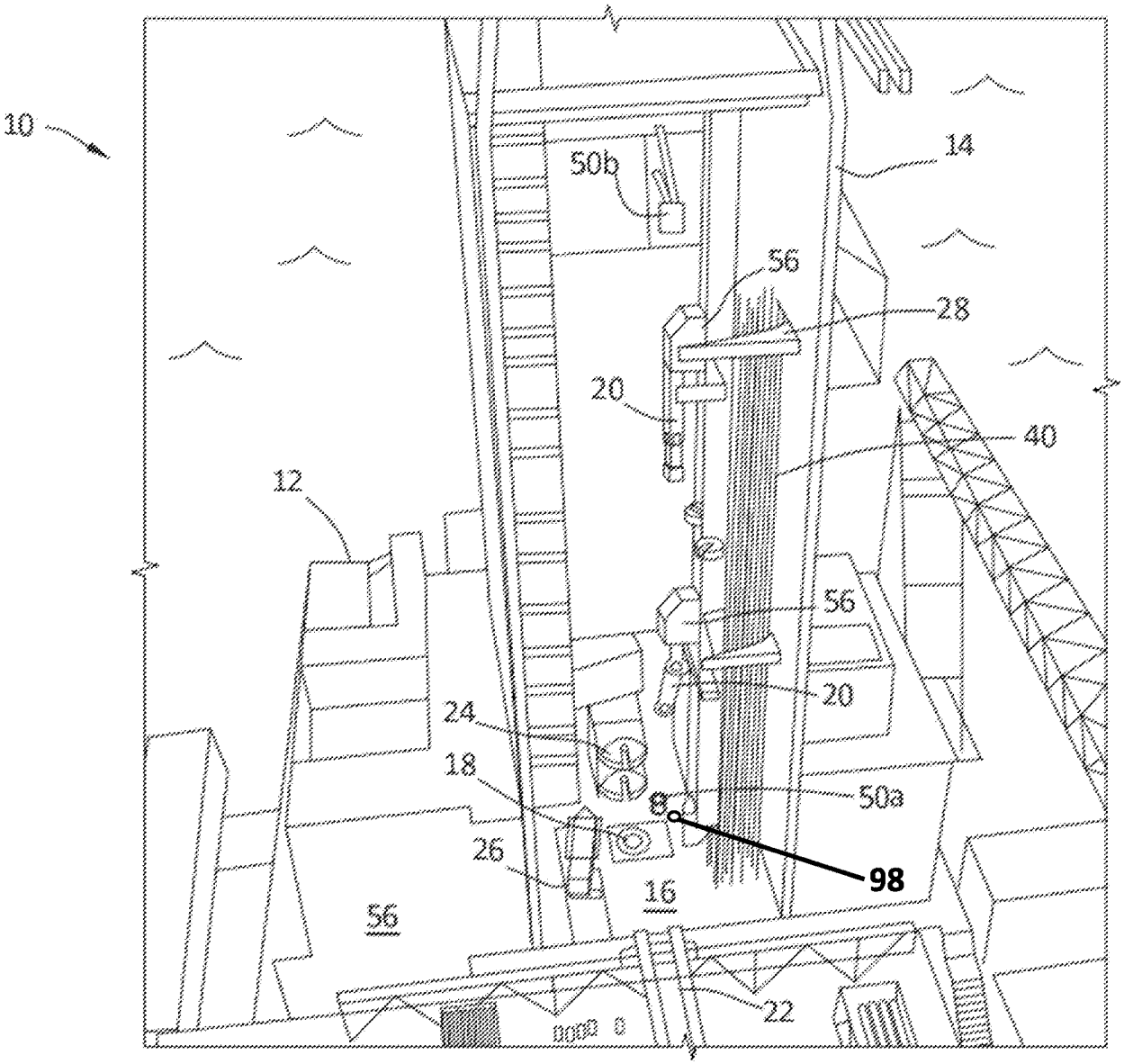
FIG. 1A is a representative perspective view of a rig with upper and lower doping devices, in accordance with certain embodiments.

FIG. 1A is a representative perspective view of a rig 10 with possible locations for upper and lower doping devices 50*b*, 50*a*, in accordance with certain embodiments. As used herein, "rig" refers to all surface structures (e.g. platform, derrick, vertical storage area, horizontal storage area, drill floor, etc.) used during a subterranean operation. The rig 10 is shown as being an offshore rig, but the principles of this disclosure are equally applicable to land-based rigs. The rig 10 can include a platform 12 with a derrick 14 extending from a rig floor 16. The rig 10 can include various equipment used for performing a subterranean operation (e.g. drilling, completion, treating, casing, workover, etc.). The equipment can include a pipe handler 22 that transfers a tubular 40 between a horizontal storage and a pipe handler 20. As used herein, "tubular" refers to an elongated cylindrical tube and can include any of the tubulars manipulated around a rig, such as tubular segments, tubular stands, tubulars, and tubular string. Therefore, in this disclosure, "tubular" is synonymous with "tubular segment," "tubular stand," and "tubular string," as well as "pipe," "pipe segment," "pipe stand," "pipe string," "casing," "casing segment," or "casing string."

The pipe handler 20 can transfer the tubular 40 between the pipe handler 22, a vertical pipe storage 28, a mouse-hole 98, upper doping device 50*b*, lower doping device 50*a*, and a well center 18. A roughneck robot 24 can be used to torque the tubular 40 onto or off of a tubular string 46 (see FIG. 1B) positioned in a wellbore, which is below the well center 18 and aligned with the well center 18. A controller 56 can be a rig controller 56 that provides control to some rig operations (such as the pipe handlers and the doping devices 50*a*, 50*b*). Alternatively, or in addition to, the controller 56 can be a controller in the pipe handler 20 that controls that pipe handler 20 and the doping devices 50*a*, 50*b*. Also, the controller 56 of the pipe handler 20 can communicate with the rig controller 56 to facilitate subterranean operations on the rig 10.

Figure 1B:
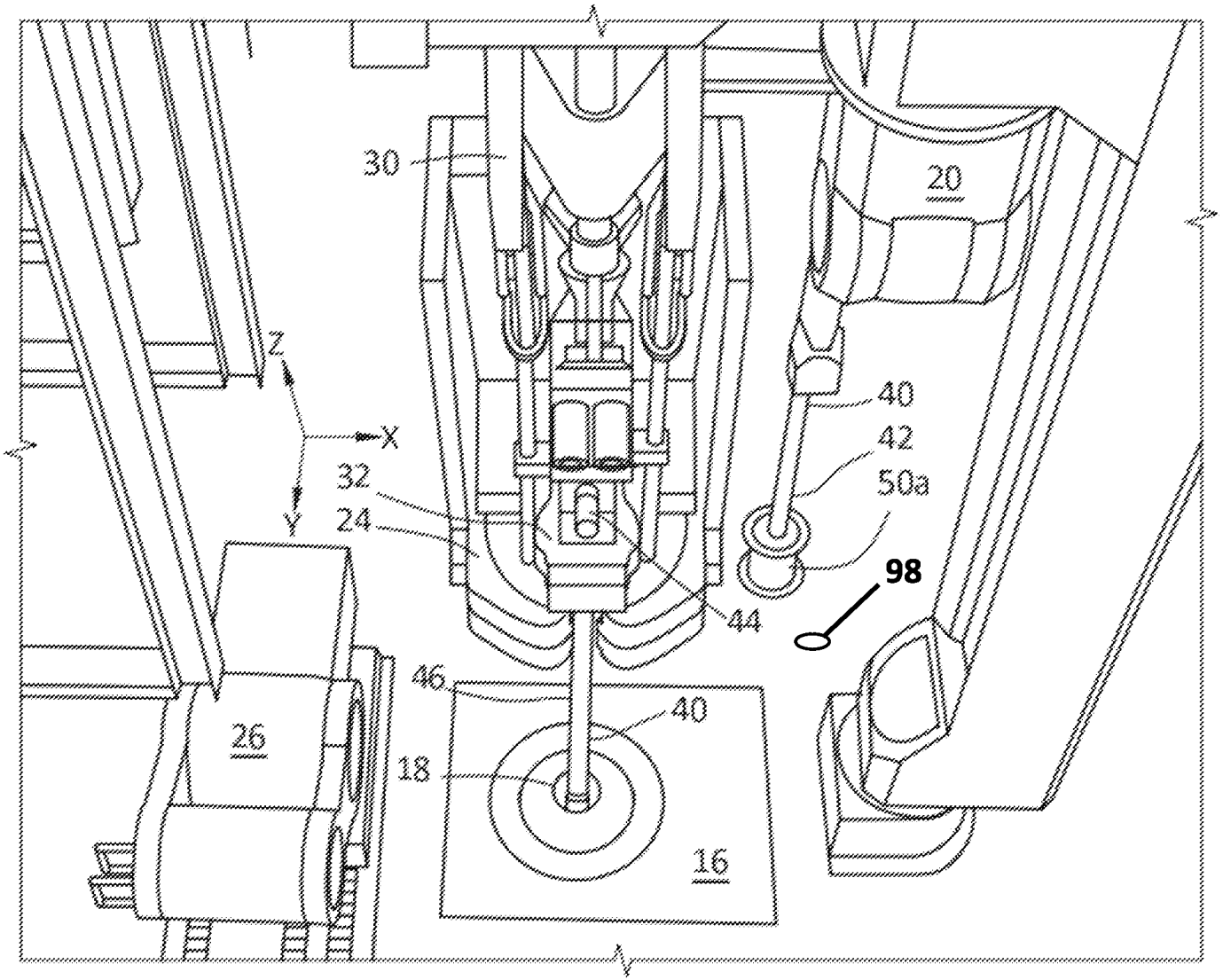
FIGS. 1B and 1C are representative perspective views of a rig with a pipe handler utilizing a doping device to apply dope to threads of a tubular during a subterranean operation, in accordance with certain embodiments.

FIG. 1B is a representative perspective view of a rig 10 with a pipe handler 20 utilizing a doping device 50*a* to clean threads of a pipe segment and apply dope to the threads during a subterranean operation (e.g. drilling, completion, etc.). FIG. 1B shows an example rig floor 16 and rig equipment (e.g. drill floor robot 26, roughneck 24, pipe handler 20, elevator 32, top drive 30, etc.) adding a tubular 40 to a tubular string 46 that is extended through the well center 18 of the drill floor 16. The pipe handler 20 can receive a tubular 40 from horizontal storage via the pipe handler 22 or extract a tubular 40 from a vertical storage of the fingerboard 28. Each tubular 40 can have a pin end 42 and a box end 44 with the pin end 42 oriented below the box end 44, in the vertical position. It should be understood that the box end 44 of the tubular 40 can include a collar that is connected to one end of the tubular 40 (e.g. casing segment). The box end 44 merely refers to an end of the tubular 40 that has internal threads, even if the internal threads are provided by a collar connected to a pipe segment (such as casing). When connecting a new tubular 40 to the tubular string 46, the threads of the tubular 40 are generally cleaned and doped prior to the connection to the tubular string 46. In this example the pin end threads are cleaned and doped (via doping device 50*a*) prior to connecting to the tubular string 46 when the tubular 40 is being added to the tubular string 46 (such as when tripping tubular string 46 into of the wellbore), and the box end 44 is cleaned and doped (via doping device 50*b*) when the tubular 40 is removed from the tubular string 46 (such as when tripping tubular string 46 out of the wellbore).

Therefore, in this example of tripping the tubular 46 into the wellbore, the pipe handler 20 can move the next tubular 40 to be connected to the tubular string 46 to the doping device 50*a* to clean and dope the threads. The pipe handler 20, with the tubular 40 in a vertical position, can position the pin end 42 into the doping device 50*a*. A seal (not shown) can engage the tubular 40 when the end 42 is positioned within the doping device 50*a* to localize fluid spray within the doping device 50*a*. The doping device 50*a* and nozzles within the doping device 50*a* remain stationary relative to the rig floor 16 while the pin end 42 is rotated within the doping device 50*a* by the pipe handler 20. While rotating the pin end 42, the pipe handler can control, via control signals to the doping device 50*a*, application of various fluids on the threads of the pin end 42. In an example operation, the pipe handler 20 can control fluid valves in the doping device 50*a* to apply the various fluids. The pipe handler 20 can control a valve to apply a spray of water to the threads of the pin end 42 while rotating the pin end 42 to clean the threads of old dope, debris, or other contaminants. Next, the pipe handler 20 can control another valve to apply a spray of air to the threads of the pin end 42 while rotating the pin end 42 to dry the threads. Next, the pipe handler 20 can control valves to apply a dope/air mixture to the threads of the pin end 42 while rotating the pin end 42 to coat the threads with a layer of dope having an average thickness across the area of the threads and on the shoulder of the pin end 42.

The pipe handler 20 can also perform a similar set of operations using the doping device 50*b* to clean and apply dope to the internal threads of the box end 44. In some examples, both the pin end 42 and the box end 44 can be cleaned and doped by the doping devices 50*a*, 50*b* sequentially. In other examples, the pipe handler 20 can clean and dope the pin end 42 before having the tubular 40 connected to the tubular string 46 (e.g. during tripping the tubular string 46 into the wellbore) and clean and dope the box end 44 after disconnecting the tubular 40 from the tubular string 46 (e.g. during tripping the tubular string 46 out of the wellbore). However, this sequence is merely an example, and these steps of cleaning and doping the pin and box ends 42, 44 can occur in any order as desired by a well plan.

Figure 1C:
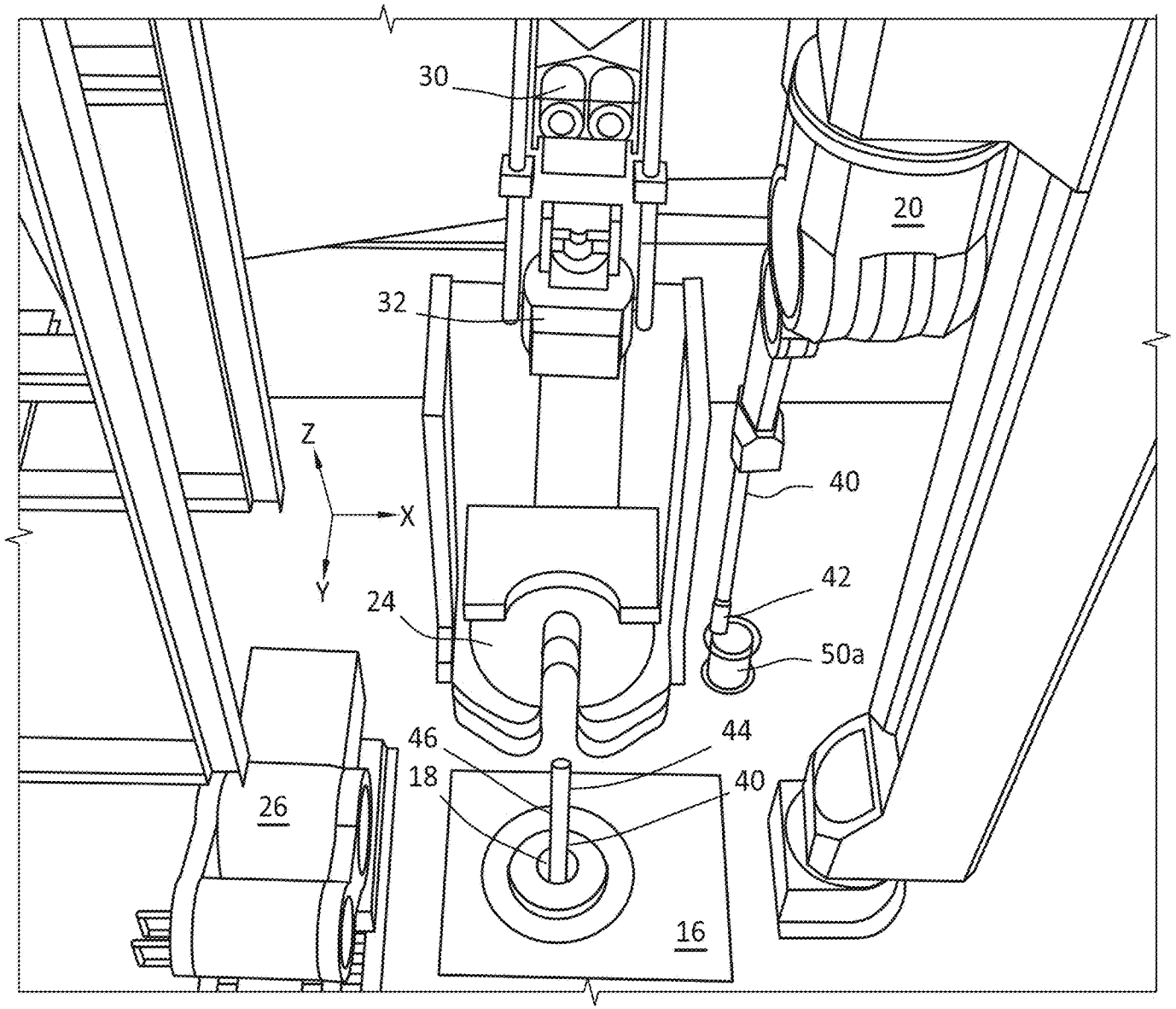

FIG. 1C is another representative perspective view of a rig with a pipe handler 20 utilizing a doping device 50*a* to apply dope to threads of a tubular 40 during a subterranean operation. Comparing this figure to FIG. 1B, the top drive 30 and elevator 32 have moved away from the tubular string 46 after having extended the tubular string 46 further into a wellbore with a remaining stump of the tubular string 46 protruding from the well center 18. The pipe handler 20 is beginning to transport the tubular 40, with freshly doped threads, to the well center 18 from the doping device 50*a*, where the tubular 40 can be connected to the tubular string 46 by the pipe handler 20, the top drive 30, and the iron roughneck 24.

Figure 2:
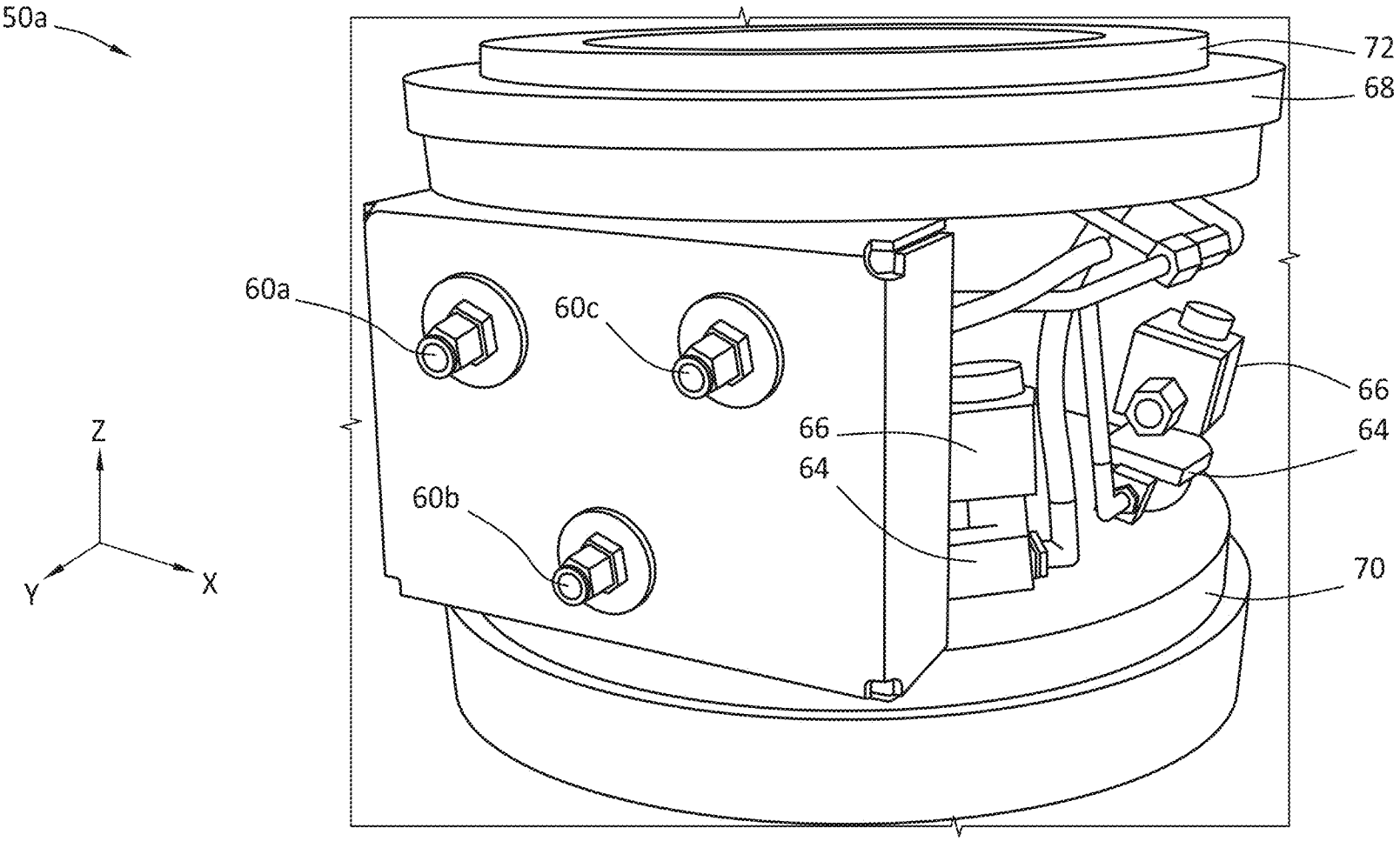
FIG. 2 is a representative perspective front view of a doping device for applying dope to threads on a pin end of a tubular, in accordance with certain embodiments.

FIG. 2 is a representative perspective front view of a doping device 50*a* for applying dope to threads on a pin end 42 of a tubular 40. The doping device 50*a*, as shown in FIGS. 1A-1C, can be mounted to the drill floor 16 or proximate the drill floor 16 in a location convenient for receiving the pin end 42 of the tubular 40. It should be understood that the doping device 50*a* (as well as doping device 50*b*) can be installed at any orientation from "0" zero degrees to 180 degrees (relative to either an X-axis or a Y-axis) on the rig 10 or proximate the rig 10, such as in a horizontal storage area, and in any azimuthal direction relative to a Z-axis (refer to FIGS. 1B-1C).

The housing (or body) 70 can provide structural support for components of the doping device 50*a* which can be used to apply dope to the pin end 42 of the tubular 40. The housing 70 can be other shapes as well, and the housing 70 can include an outer shell (not shown) that can cover and protect the components. One unique feature of the doping devices 50*a*, 50*b* is that they do not have components that rotate relative to the rig floor 16 (or any other structure to which they may be attached). The rig 10 uses the pipe handler 20 to rotate the tubular 40 with respect to the doping device 50*a*, 50*b* and the pipe handler 20 controls the nozzles in the doping devices 50*a*, 50*b* to apply various fluids (e.g. water, air, dope) to the threads of the tubular 40 as the tubular 40 is being rotated. Each fluid can have separate inputs to the doping devices 50*a*, 50*b* with valves, actuators, tubing, and nozzles used to direct the fluids to an end of the tubular 40 when the end of the tubular 40 is inserted into (or positioned proximate) the doping devices 50*a*, 50*b*.

Referring again to FIG. 2, inlets 60*a*, 60*b*,60*c* can provide connections to external fluid sources for suppling fluids that can include dope, water, and air, respectively, in this example of the doping device 50*a*. Tubing can route the fluids to various valves 64 that are coupled to respective actuators 66 to selectively apply the respective fluid to the threads and shoulder of the pin end 42 of the tubular 40. These components can be fixedly coupled to the housing 70 and the housing 70 can be fixedly coupled to or any structure on or off the rig 10 (e.g. rig floor 16, horizontal storage area, derrick 14, platform 12, etc.). The housing 70 can be oriented such that the pin end 42 of the tubular 40 enters the doping device 50*a* through vertical motion. However, the housing 70 can be mounted in various other orientations from 0 "zero" to 180 degrees relative to the rig floor 16 in keeping with the principles of this disclosure. The doping device 50*a* can include a keeper ring 68 used to radially confine a seal at the entrance of the doping device 50*a*. A retainer 72 can be used to axially confine the seal at the entrance.

Figure 3:
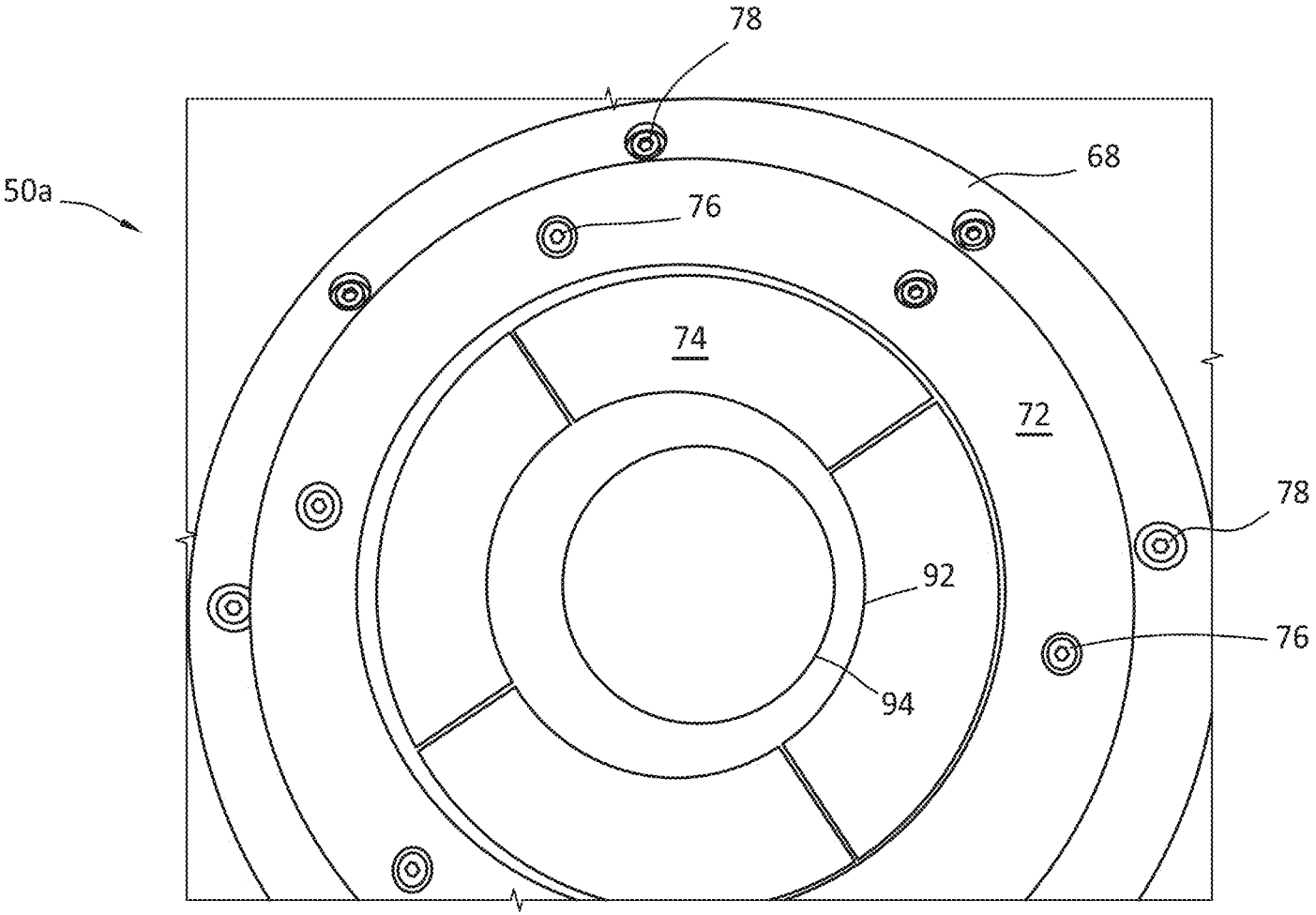
FIG. 3 is a representative top view of a doping device for applying dope to threads on a pin end of a tubular, in accordance with certain embodiments.

FIG. 3 is a representative top view of the doping device 50*a* for applying fluids (e.g. dope, water, and air) to threads and a shoulder of a pin end 42 of a tubular 40. The entrance of the doping device 50*a* is surrounded by a segmented seal 74 that can engage an outer surface of the tubular 40 when the pin end 42 is inserted into the doping device 50*a*. The segmented seal 74 can be a resilient material (e.g. an elastomer, a rubber, etc.) with slits cut radially outward from a center opening or the seal 74 can be made from individual segments positioned to form a circular seal with an inner opening 92, or the seal can be made of individual segments that at least partially overlap adjacent segments to form a circular seal. The seal 74 can be radially confined to the position at the top of the doping device 50*a* by the keeper ring 68 which is shown attached by fasteners 78 to the housing 70. The retainer 72 can overlay a radially outward portion of the seal 74 and confine the seal 74 to the housing via fasteners 76. An opening 94 through the bottom of the housing 70 can be used to drain excess fluids when the doping device 50*a* is applying the fluids to the tubular pin end 42. This opening 94 can be modified as needed to allow for proper draining when the doping device 50*a* is mounted to the rig 10 in various orientations from 0 "zero" to 180 degrees relative to the rig floor 16.

The doping device 50*a* can be configured to accommodate various types of tubulars 40 as well as various sizes of the various types. The larger size tubulars, such as casing, as well as the smaller size tubulars, such as smaller diameter drill pipe, can be cleaned and doped by the doping device 50*a*, without adjusting the positions of the nozzles in the doping device 50*a*. For example, the size of tubulars 40 can include, but not limited to, 2⅜", 2⅞", 3½", 4", 4½", 5", 5½", 6⅝", 7", 7⅝", 8⅝", 8⅝", 9⅝", 10¾", 11¾", 13⅜", 16", 18⅝", and 20" diameter tubing.

Figure 4:
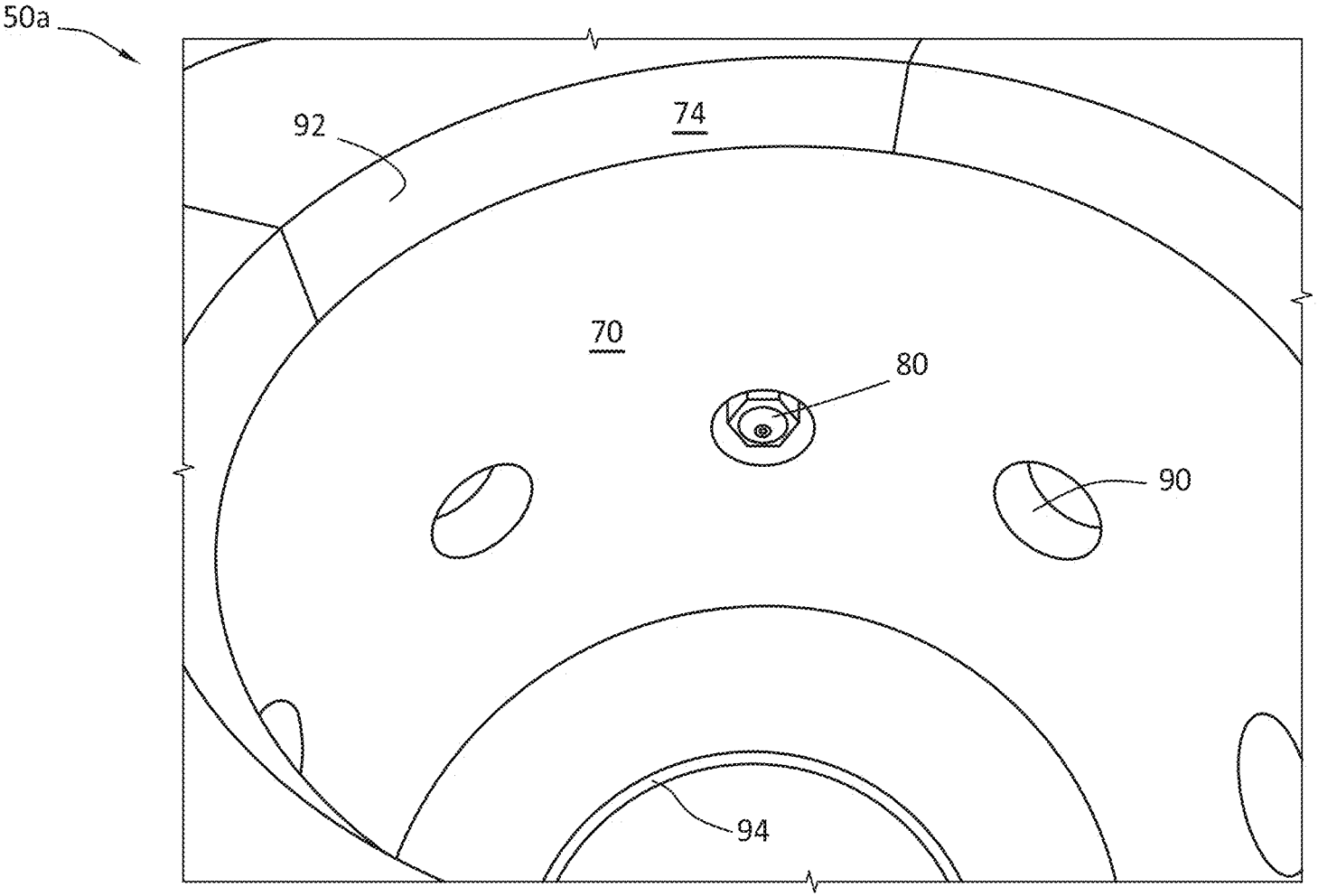
FIG. 4 is a representative perspective view of an inside portion of a doping device for applying dope to threads on a pin end of a tubular, in accordance with certain embodiments.

FIG. 4 is a representative perspective view of an inside portion of a doping device 50*a* for applying dope to threads on a pin end 42 of a tubular 40. The segmented seal 74 is shown at the entrance of the doping device 50*a* and forms the opening 92 at the entrance. A plurality of openings 90 can be circumferentially distributed around the housing 70 with a nozzle installed in select ones of the openings 90. Various configurations of the doping device 50*a* can have various configurations of nozzles 80 distributed around the housing 70. The openings 90 are oriented such that a nozzle installed in the openings 90 is directed radially inward toward a central axis of the doping device 50*a*. In this example, a surface near the bottom of the doping device 50*a* can be tapered toward the opening 94 to facilitate movement of excess fluids to the opening 94. However, in other orientations (e.g. 180 degrees) the opening 94 may not be used to exhaust excess fluids. In other orientations, the tapered surface may act as a shield to reduce overspray from the doping device 50*a*.

Figure 5:
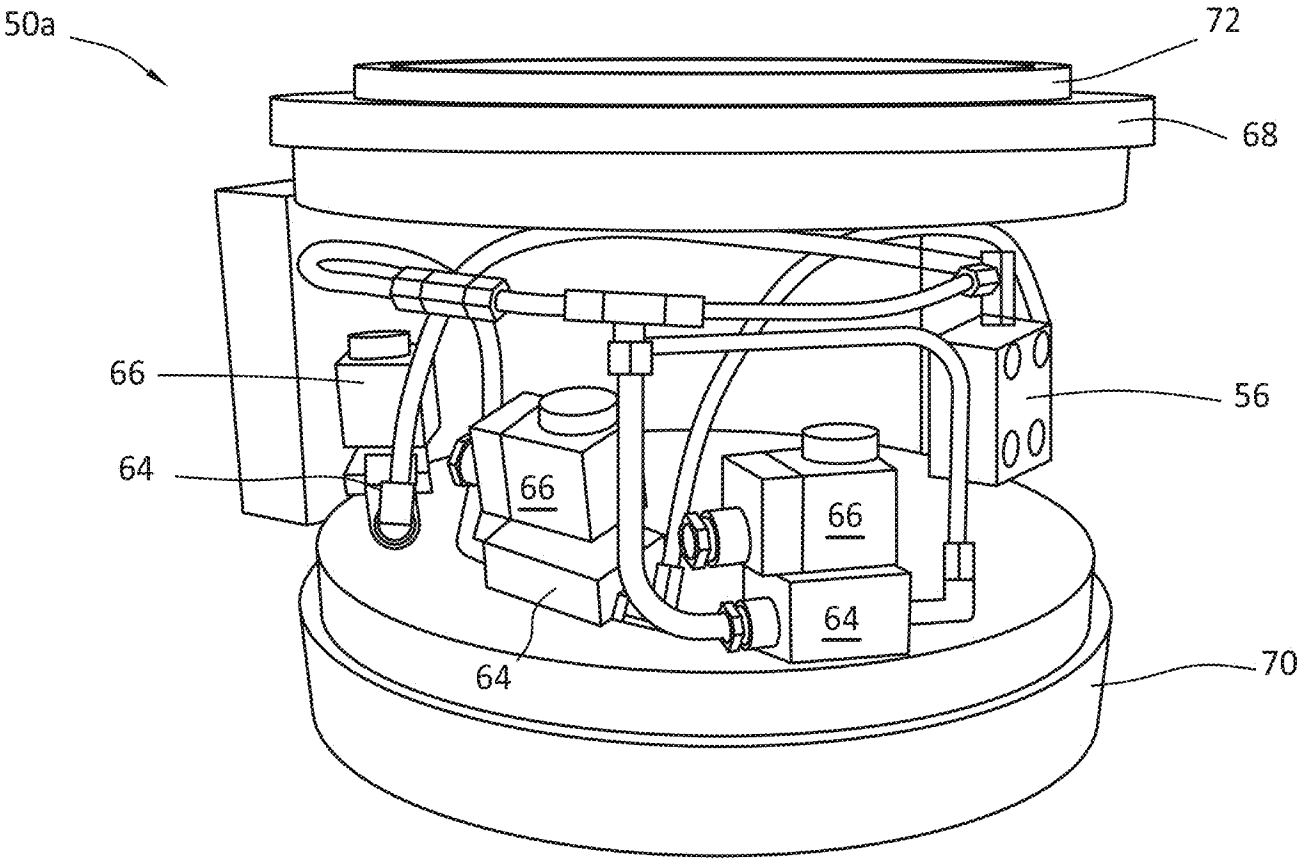
FIG. 5 is a representative perspective rear view of a doping device for applying dope to threads on a pin end of a tubular, in accordance with certain embodiments.

FIG. 5 is a representative perspective rear view of the doping device 50*a* for applying dope to threads on the pin end 42 of the tubular 40. This view shows various valves 64 with respective actuators 66 which can be controlled via a controller in the pipe handler 20 to control application of respective fluids to the tubular 40.

Figure 6B:
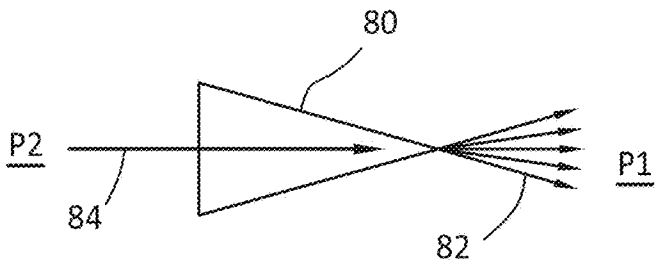
FIG. 6B is a representative flow diagram of fluid flow from a fluid source to and through the nozzle of FIG. 6A, in accordance with certain embodiments.
Figure 6D:
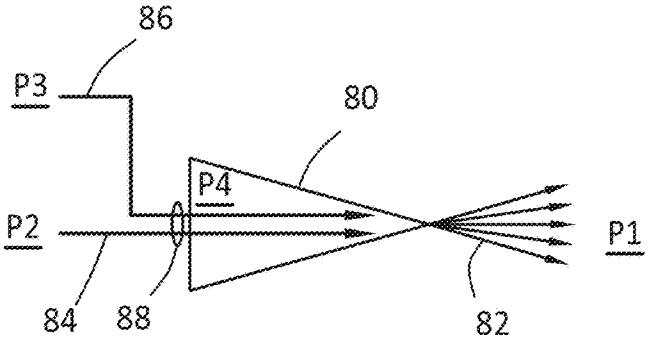
FIG. 6D is a representative flow diagram of fluid flow from fluid sources to and through the nozzle of FIG. 6C, in accordance with certain embodiments.
Figure 6A:
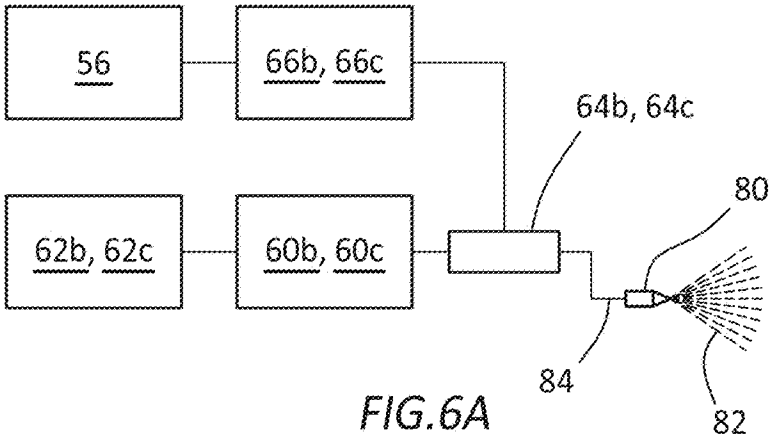
FIG. 6A is a representative functional block diagram of a fluid source that supplies fluid to a nozzle, in accordance with certain embodiments.

FIG. 6A is a representative functional block diagram of a fluid source 62*b*, 62*c* that can supply fluid 84 to a nozzle 80 through a respective inlet connection 60*b*, 60*c* and a respective valve 64*b*, 64*c*, which is actuated by a respective actuator 66*b*, 66*c*. The controller 56 can be a rig controller positioned on or off the rig 10, or the controller 56 can be a controller in the pipe handler 20. The controller 56 can enable or disable fluid flow through one or more nozzles in the doping device 50*a*, 50*b*. For example, the controller 56 can turn ON individual nozzles 80 separately or in combination by energizing a respective actuator 66*b-c* to open a respective valve 64*b-c* and allow a respective fluid to flow through the respective nozzle 80, thereby spraying the fluid on to a portion of the tubular 40, where the portion can include threads and a shoulder of the end of the tubular 40. The controller 56 can turn OFF individual nozzles 80 by deenergizing the respective actuator 66*b-c* to close a respective valve 64*b-c* and prevent a respective fluid from flowing through the respective nozzle 80, thereby preventing fluid from being applied to the portion of the tubular 40.

This block diagram can represent the flow of water 84 from the source 62*b*, through an inlet connection 60*b*, through a valve 64*b* (when actuated by an actuator 66*b*), and through the nozzle 80 to form a spray pattern 82 of the water 84 that can be directed to the threads 120 and a shoulder of the end of the tubular 40. This spray pattern 82 of the water 84 can be used to clean (spray away) old dope, debris, or other contaminants from the threads and shoulder in preparation for application of new dope to the threads 120 and shoulder.

Alternatively, this block diagram can represent the flow of air 84 from the source 62*c*, through an inlet connection 60*c*, through a valve 64*c* (when actuated by an actuator 66*c*), and through the nozzle 80 to form a spray pattern 82 of the air 84 that can be directed to the threads and shoulder of the end of the tubular 40. This spray pattern 82 of the air 84 can be used to clean (spray away) old dope, debris, or other contaminants from the threads and shoulder as well as dry the threads and shoulder in preparation for application of new dope to the threads 120 and shoulder. In general, water spray 82 can be more effective for removing old dope, debris, or other contaminants from the threads 120 and shoulder than the air spray 82, with the air spray 82 being more effective for drying the threads after the cleaning process. However, either fluid can be used for removing old dope, debris, or other contaminants from the threads 120 and shoulder.

FIG. 6B is a representative flow diagram of fluid flow from a fluid source to and through the nozzle of FIG. 6A. The fluid 84 can be stored at a pressure P2 in a container that is remote from the doping device 50*a*, 50*b*. The pressure P2 can be used to drive the fluid 84 to and through the nozzle 80 to produce a spray pattern 82 that sprays into an environment with a pressure P1. Therefore, the pressure differential between pressure P2 and pressure P1 drives the fluid 84 through the nozzle 80. The spray pattern 82 can provide a substantially uniform distribution of the fluid 84 over an arc distance of 20 degrees, 30 degrees, 45 degrees, 60 degrees, 90 degrees, and 120 degrees. See specifications for example nozzles 80 in FIG. 6E. Two preferred examples of nozzles 80 are shown in the FIG. 6E and these particular examples are JBW-1310 and JBW-1385 from PNR ITALIA, which can be made from various material (e.g. stainless steel, brass, etc.). These nozzles 80 are described as flat fan nozzles which work particularly well with the doping device 50*a*, 50*b*. According to FIG. 6E, the JBW-1310 nozzle can deliver 5.66 liters per minute at 10 bar (145 psi) pressure, and the JBW-1385 nozzle can deliver 7.03 liters per minute at 10 bar (145 psi) pressure. Higher pressures P2 can deliver a higher rate of fluid through each example nozzle 80. Other nozzles 80 can also be used in the doping devices 50*a*, 50*b* as particular installation requirements may vary. These example nozzles 80 indicate compatible specifications for some nozzles that can support the doping devices 50*a*, 50*b*. However, nozzles other than these examples can also be used with the doping devices 50*a*, 50*b*.

Figure 6C:
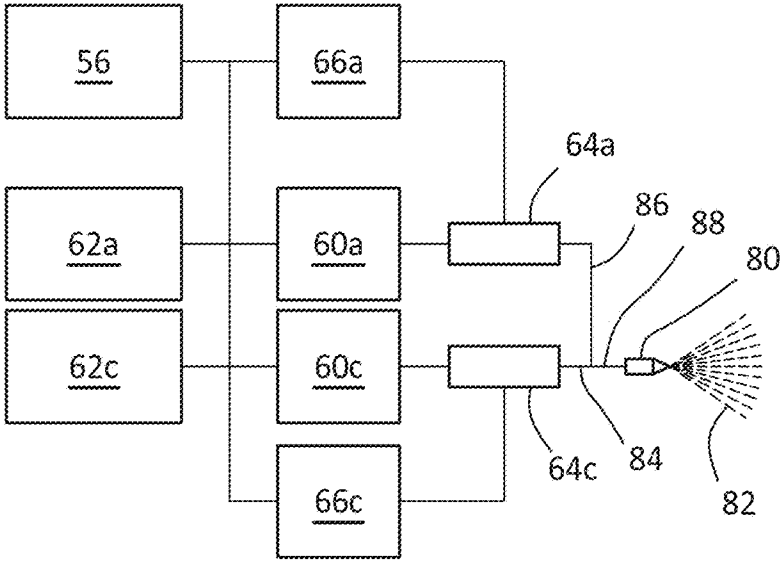
FIG. 6C is a representative functional block diagram of fluid sources that supply fluid to a nozzle, in accordance with certain embodiments.
Figure 6E:
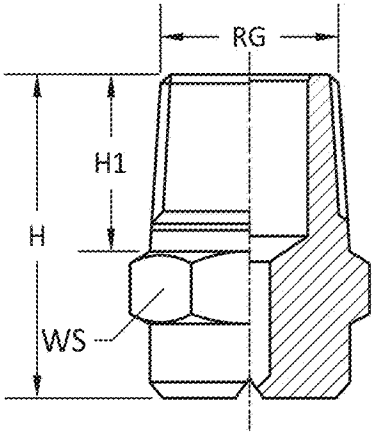
FIG. 6E is a representative nozzle (with datasheet) that can be used in the doping device, in accordance with certain embodiments.
Figure 6E:
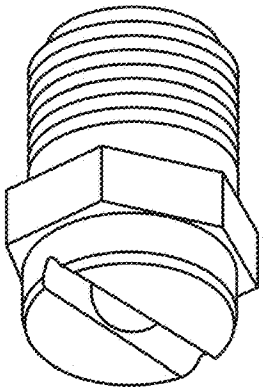

FIG. 6C is a representative functional block diagram of fluid sources 62*a*, 62*c* that supply fluids 86, 84, respectively, through respective inlets 60*a*, 60*c* and respective valves 64*a*, 64*c* (when actuated by respective actuators 66*a*, 66*c*) to a nozzle 80. The controller 56 can be a rig controller positioned on or off the rig 10, or the controller 56 can be a controller in the pipe handler 20. The controller 56 can enable or disable fluid flow through the nozzle 80 in a doping device 50*a*, 50*b*. For example, the controller 56 can turn ON the nozzle 80 by energizing one or more of the actuators 66*a*, 66*c* to open respective valve 64*a*, 64*c* and allow the respective fluids 86, 84 to flow through the nozzle 80, thereby spraying the fluid on to a portion of the tubular 40, where the portion can include threads and a shoulder of the end of the tubular 40. When one of the actuators 66*a*, 66*c* are energized, then one of the fluids 86, 84 can flow through the nozzle 80. When both of the actuators 66*a*, 66*c* are energized, the fluids 86, 84 can impinge each other to create a fluid mixture of the fluids 86, 84 that can flow through the nozzle 80. The controller 56 can turn OFF individual nozzles 80 by deenergizing the respective actuator 66*a*, 66*c* to close a respective valve 64*a*, 64*c* and prevent a respective fluid from flowing through the respective nozzle 80, thereby preventing fluid from being applied to the portion of the tubular 40.

This block diagram can represent the flow of air 84 from the source 62*c*, through an inlet connection 60*c*, through a valve 64*c* (when actuated by an actuator 66), and to a mixing connection where the air 84 can be mixed with dope 86 to produce an air/dope mixture 88. The dope 86 can flow from the source 62*a*, through an inlet connection 60*a*, through a valve 64*a* (when actuated by an actuator 66), and to the mixing connection where the air 84 can be mixed with dope 86 to produce the air/dope mixture 88. At the mixing connection, the dope 86 can enter the connection at an angle (e.g. 90, 85, 80, 75, 70, 65, 60, 55, 50, 45, 40, 35, 30, or 15 degree angle) such that the pressurized air 84 acts to atomize (or at least breakup) the dope 86 and produce the air/dope mixture 88. The air/dope mixture 88 can then be driven through the nozzle 80 to produce the spray pattern 82 which can be directed at the threads and shoulder of the end of the tubular 40, thereby applying the dope 86 to the threads and the shoulder. The air/dope mixture 88 can provide a generally uniform application of dope 86 to the threads and shoulder since the tubular 40 is rotated while the spray pattern 82 is directed to the end of the tubular 40.

FIG. 6D is a representative flow diagram of the flow of fluids 86, 84 from respective fluid sources 62*a*, 62*c* to and through the nozzle 80 of FIG. 6C. The air 84 can be supplied at a pressure P2 to the mixing connection, with the dope 86 being supplied to the mixing connection at a pressure of P3. The pressures P2, P3 can be substantially equal to each other, but they can also be different pressures. However, the pressures P2, P3 should be at a level that facilitates mixing the dope 86 with the air 84 (such as atomizing the dope 86 with the air 84) and drives the mixture 88 through the nozzle 80 to produce the spray pattern 82. The mixing connection can produce a pressure drop, therefore, the air/dope mixture 88 can be delivered to the nozzle 80 at a pressure P4 which can be less than either of the pressures P2 or P3.

In each of the above examples, the pressures P2 or P3 can be less than 200 bar (2901 psi) and greater than 2 bar (29 psi), or less than 150 bar (2176 psi) and greater than 2 bar (29 psi), or less than 140 bar (2031 psi) and greater than 3 bar (44 psi), or less than 140 bar (2031 psi) and greater than 3.85 bar (56 psi), or less than 140 bar (2031 psi) and greater than 4 bar (58 psi), or less than 140 bar (2031 psi) and greater than 5 bar (73 psi), or less than 140 bar (2031 psi) and greater than 8 bar (116 psi), or less than 140 bar (2031 psi) and greater than 10 bar (145 psi), or less than 135 bar (2031 psi) and greater than 110 bar (1595 psi), or less than 130 bar (1885 psi) and greater than 120 bar (1740 psi). Adjustments of the pressures P2, P3 within these ranges may be needed to optimize the application of the dope on the threads. Pressure P4 can be calculated by determining the pressure drop across the nozzle 80 and deducting the pressure drop from either of the pressures P2, P3.

Figure 7B:
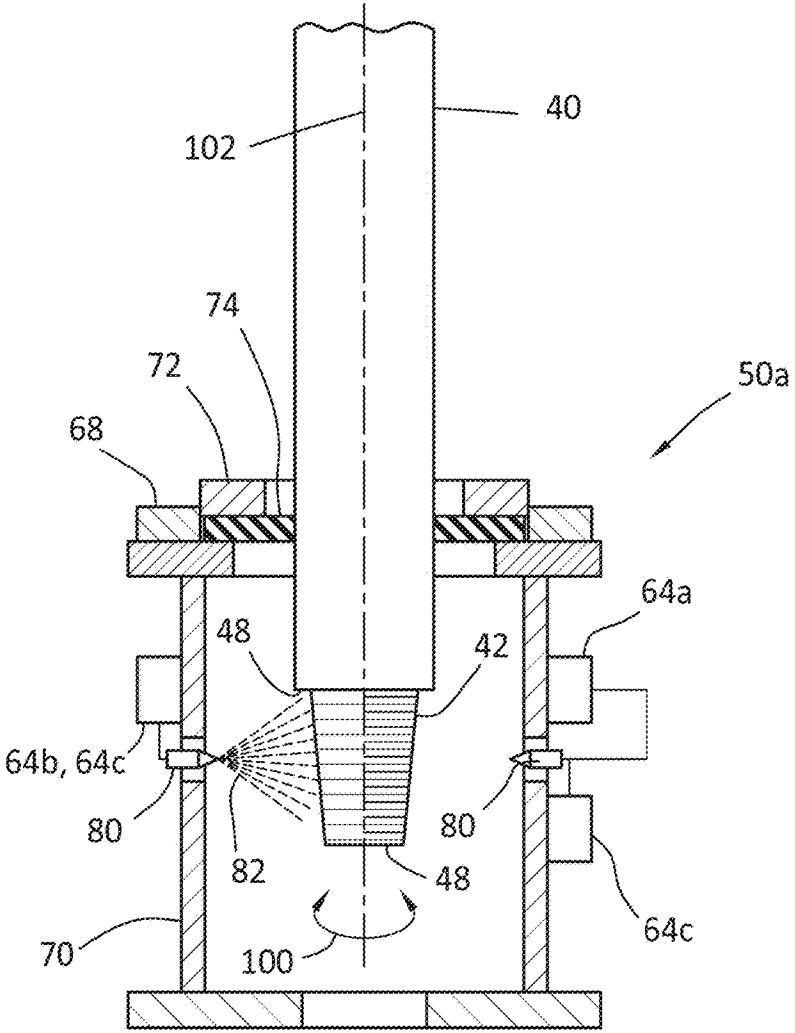
FIGS. 7B, 7C, and 7D are representative partial cross-sectional views of the doping device of FIG. 7A in various stages of cleaning and doping the threads on the pin end after the pin end has been positioned within the doping device, in accordance with certain embodiments.
Figure 7A:
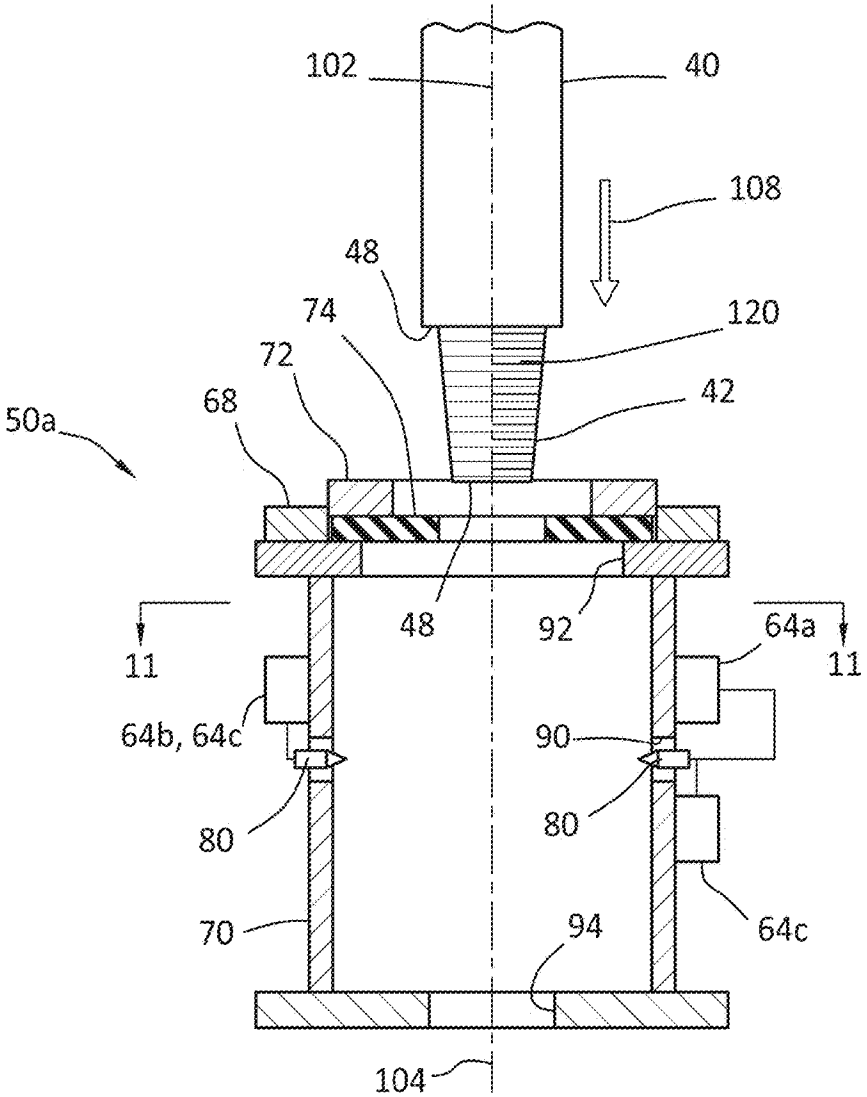
FIG. 7A is a representative partial cross-sectional view of a doping device for applying dope to threads on a pin end of a tubular prior to the pin end being positioned within the doping device, in accordance with certain embodiments.

FIG. 7A is a representative partial cross-sectional view of a doping device 50*a* for applying dope 86 to threads 120 and shoulders 48 on a pin end 42 of a tubular 40 prior to the pin end 42 being positioned within the doping device 50*a*. The doping device 50*a* is similar to the doping devices 50*a* in FIGS. 2-5. The circular housing 70 can provide structural support for the valves, 64*a*-*c*, actuators 66*a*-*c*, and nozzles 80. The housing 70 can include an opening 94 at its base that allow drainage of excess fluids during cleaning and doping procedures. Openings 90 in a circular wall of the housing 70 can receive the nozzles 80 used to spray fluids onto a tubular pin end 42 that is positioned within the housing 70.

The housing 70 can include an opening 92 at the top of the doping device 50*a* which allows access for the pin end 42 to be inserted into the housing 70 for cleaning and doping the threads 120 and shoulder 48. A seal 74 can be positioned around the opening 92 and can sealingly engage the tubular 40 when the pin end 42 is inserted (arrow 108) into the housing 70 through the opening 92. The keeper ring 68 and the retainer 72 can be used to hold the seal 74 in place as the pin end 42 is inserted into and retracted from the doping device 50*a*. A center longitudinal axis 102 of the tubular 40 can be substantially aligned and/or substantially parallel to a center axis 104 of the doping device 50*a*. However, the longitudinal axis 102 and the center axis 104 are not required to be aligned or substantially parallel to each other. It is understood, that the doping device 50*a* can still clean the threads 120 and apply dope to the threads 120 with the longitudinal axis 102 and the center axis 104 being somewhat out of alignment and not necessarily in parallel with each other. However, any misalignment or lack of parallelism between the axes 102, 104 must not prevent distribution of the fluids to the threads 120 and shoulders 48 by the spray pattern from the nozzle(s) 80.

Figure 11:
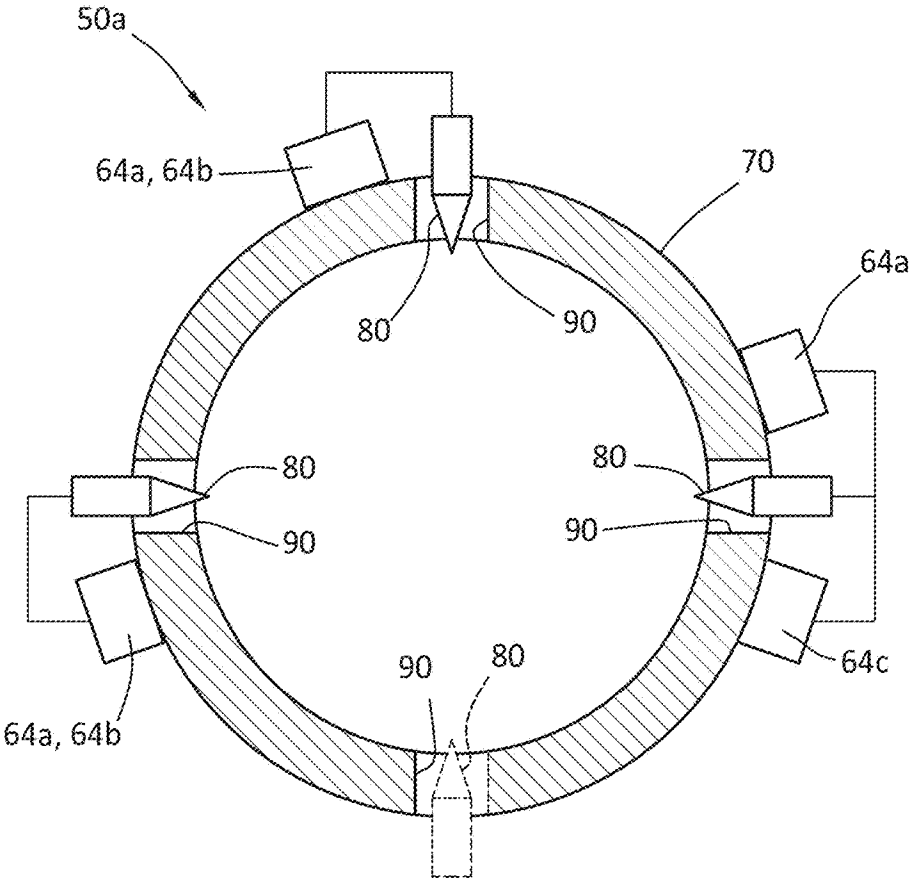
FIG. 11 is a representative partial cross-sectional view 11-11, as indicated in FIG. 7A, of a doping device for applying dope to threads on a pin end of a tubular, in accordance with certain embodiments.

The nozzle 80 on the left side of the housing can receive air or water from the respective valve 64*b*, 64*c* to deliver air or water to the pin end 42. As described above related to FIGS. 6A, 6B, a fluid source (62*b* or 62*c*) can supply fluid to the nozzle 80 through a valve (64*b* or 64*c*, respectively). There can be two separate nozzles 80, with one nozzle 80 receiving water from the valve 64*b* and another nozzle 80 receiving air from a valve 64*c*. However, there can also be one nozzle 80 that selectively receives water from the valve 64*b* and air from a valve 64*c*. The nozzle 80 on the right side of the housing 70 can be configured as indicated in FIGS. 6C, 6D, with one nozzle 80 receiving an air/dope mixture 88 from the valves 64*a*,64*c*. The nozzles 80 can be distributed around the housing in various other circumferential positions. The two nozzles 80 are shown 180 degrees offset from each other for discussion purposes only. FIG. 11 shows another example nozzle configurations and other nozzle configurations are envisioned as well, such as nozzles offset 60 degrees from each other, or 45 degrees from each other, etc.

The doping device 50*a* is configured to accommodate various types of tubulars 40 as well as various sizes of the various types. The larger size tubulars, such as casing, as well as the smaller size tubulars, such as smaller diameter drill pipe, can be cleaned and doped by the doping device, without adjusting the positions of the nozzles in the doping device 50*a*. For example, the size of tubulars 40 can include, but not limited to, 2⅜", 2⅞", 3½", 4", 4½", 5", 5½", 6⅝", 7", 7⅝", 8⅝", 8⅝", 9⅝", 10¾", 11¾", 13⅜", 16", 18⅝", and 20" diameter tubing.

FIG. 7B is a representative partial cross-sectional view of the doping device 50*a* of FIG. 7A performing a cleaning operation on the threads 120 and shoulders 48 of the pin end 42. The controller 56 (e.g. rig controller or pipe handler 20 controller) has enabled the flow of fluid (e.g. water) to the nozzle 80 at a pressure of P2 by controlling a respective actuator 66 while the tubular 40 is being rotated (arrows 100) by the controller 56, via the pipe handler 20. The seal 74 can be configured to rotate with the tubular 40 while engaged with the tubular 40 or remain stationary relative to the housing 70 and the tubular 40 rotate relative to seal 74. In FIG. 7B, the fluid can be water that is applied to the threads 120 and shoulders 48 via the spray pattern 82 to clean the threads 120 and shoulders 48 of old dope, debris, or other contaminants. The excess fluid can drain through the opening 94.

Figure 7D:
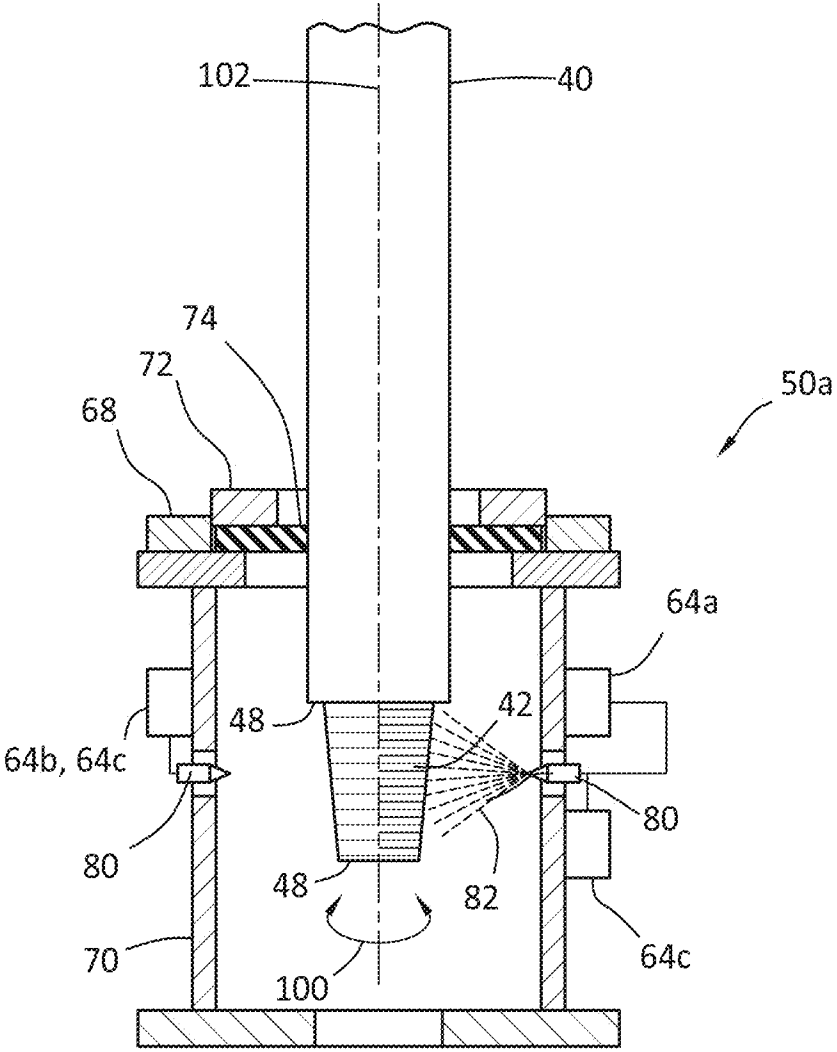
Figure 7C:
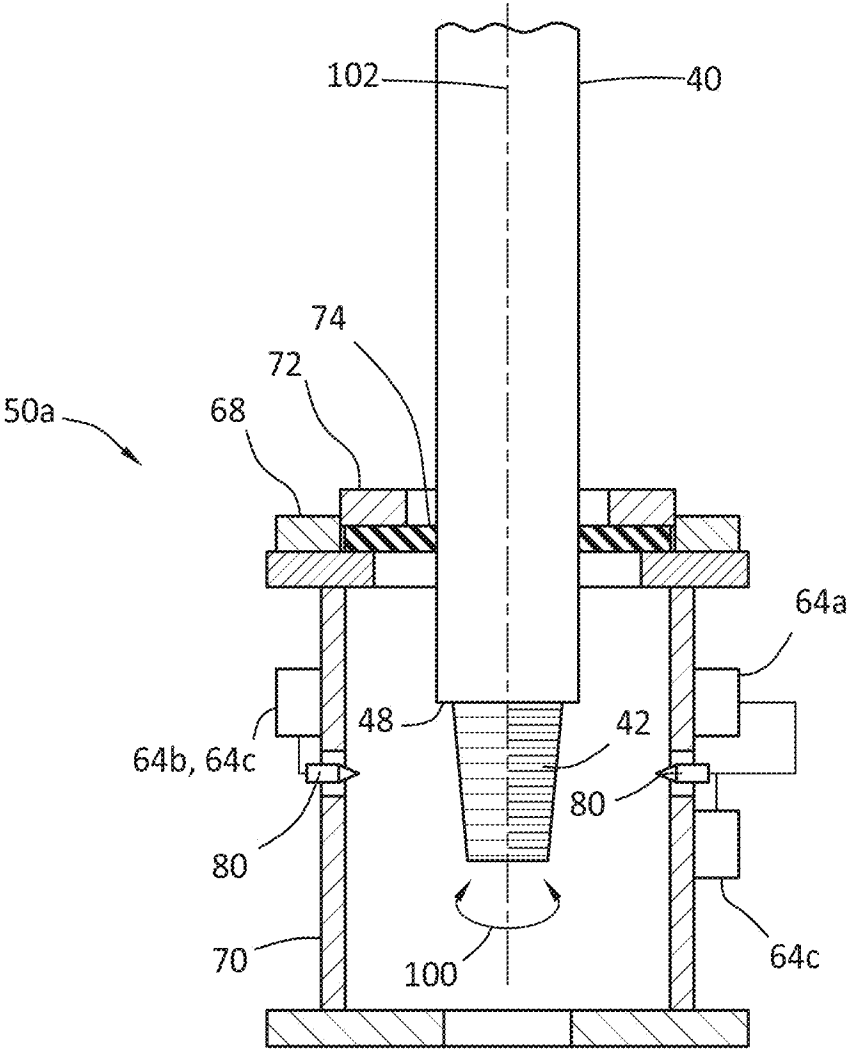

FIG. 7C is a representative partial cross-sectional view of the doping device 50*a* of FIG. 7A performing a drying operation of the threads 120 and shoulders 48 of the pin end 42. The controller 56 has enabled the flow of fluid (e.g. air) to a nozzle 80 (not shown) at a pressure of P2 by controlling a respective actuator 66 while the tubular 40 is being rotated (arrows 100) by the pipe handler 20. In FIG. 7C, the fluid can be air that is applied to the threads 120 and shoulders 48 via the spray pattern 82 to dry the threads 120 and shoulders 48 after being cleaned by the water.

FIG. 7D is a representative partial cross-sectional view of the doping device 50*a* of FIG. 7A performing a doping operation on the threads 120 and shoulders 48 of the pin end 42. The controller 56 has enabled the flow of two fluids (e.g. air and dope) to the nozzle 80 at a respective pressure of P2, P3 by controlling a respective actuator 66 while the tubular 40 is being rotated (arrows 100) by the pipe handler 20. In FIG. 7D, the fluids can be air and dope, with the dope being impinged by the air at an angle to atomize the dope to produce an air/dope mixture, with the air/dope mixture being applied to the threads 120 and shoulders 48, via the spray pattern 82, to dope the threads 120 and shoulders 48. A generally uniform distribution of the dope on the area of the threads 120 and shoulders 48 is provided by the doping device 50*a*.

Referring again to FIG. 7A, a pipe handler 20 (not shown) can be used to manipulate the end 42 of the tubular 40 into the doping device 50*a*. It is preferred that the tubular 40 is not rotating as the end 42 is extended into the doping device 50*a*, but the tubular 40 can be rotated as it enters the doping device 50*a* in keeping with the principles of this disclosure. As the end 42 is extended into the doping device 50*a* through the opening 92 a seal 74 can be used to engage an outer surface of the tubular 40 to minimize over spray of fluids out of the doping device 50*a* during operation. The seal 74 can be stationary relative to the doping device 50*a* with the tubular being rotatable relative to the seal 74. However, the seal 74 can rotate relative to the doping device 50*a* and rotate with the tubular when the tubular 40 is rotated. In this example, nozzles 80 are circumferentially spaced apart around the body 70 of the doping device 50*a* as shown in FIG. 11. However, the nozzles can be spaced apart axially, circumferentially, or combinations thereof about the body 70. For the doping device 50*a*, the nozzles 80 are directed radially inward to direct fluid spray 82 onto the external threads 120 and shoulders 48 of the pin end 42.

Referring to FIG. 7B, once the pipe handler 20 has positioned the pin end 42 within the body 70 of the doping device 50*a*, the pipe handler 20 can begin rotating (arrows 100) the tubular 40 (and thus the pin end 42) relative to the doping device 50*a*. By the pipe handler 20 rotating the tubular 40, the nozzles 80 can remain stationary relative to the doping device 50*a*, thus making the construction and operation of the doping device 50*a* much simpler and with few moving parts, thereby possibly increasing a life span of the doping device 50*a*. As the pin end 42 rotates (arrows 100), the controller 56 can turn ON fluid flow (e.g. water) to a first nozzle 80 to clean away any old dope or debris from the threads 120 and shoulders 48. The controller 56 can then turn OFF fluid flow to the first nozzle 80 after cleaning operation is complete.

Referring to FIG. 7C, while the tubular 40 is rotated, the controller 56 can turn ON fluid flow (e.g. air) to a second nozzle 80 (which can also be the same as the first nozzle 80, but it is preferred that the first and second nozzles 80 are separate nozzles) to remove any remaining fluid from the previous operation (e.g. removing water from threads 120 and shoulders 48) and drying the threads and shoulders in preparation for applying dope to the threads 120 and shoulders 48. The second nozzle separate from the first nozzle can be located behind the tubular 40 and would not be visible in FIG. 7C.

Referring to FIG. 7D, once the threads 120 and shoulders 48 are cleaned and dried, they are ready for the dope to be applied. The pipe handler 20 can begin (or maintain) rotating the tubular 40 relative to the doping device 50*a*. As the pin end 42 rotates (arrows 100), the controller 56 can turn ON fluid flow (e.g. dope and water) to a third nozzle 80 to apply a generally uniform coating or layer of the dope on the threads 120 and shoulders 48. The controller 56 can then turn OFF fluid flow to the third nozzle 80 after the doping operation is complete. The pipe handler 20 can cease rotating the tubular 40 and extract the doped pin end 42 from the doping device 50*a*. The doped pin end 42 can then be connected to a box end 44 of a tubular 40 to build a pipe stand, extend a drill string, etc.

FIGS. 7A-7D illustrate a sequence of possible operations needed in some embodiments for doping a pin end 42 of the tubular 40. Similar operations may be needed in some embodiments for doping a box end 44 of the tubular 40 (refer to FIGS. 9A-10D and 15-18). In some embodiments, these operations work in cooperation with each other to produce a generally uniform coating of dope onto the threads 120 and shoulders of the tubular 40, an example of which is shown in FIG. 7E.

Figure 7E:
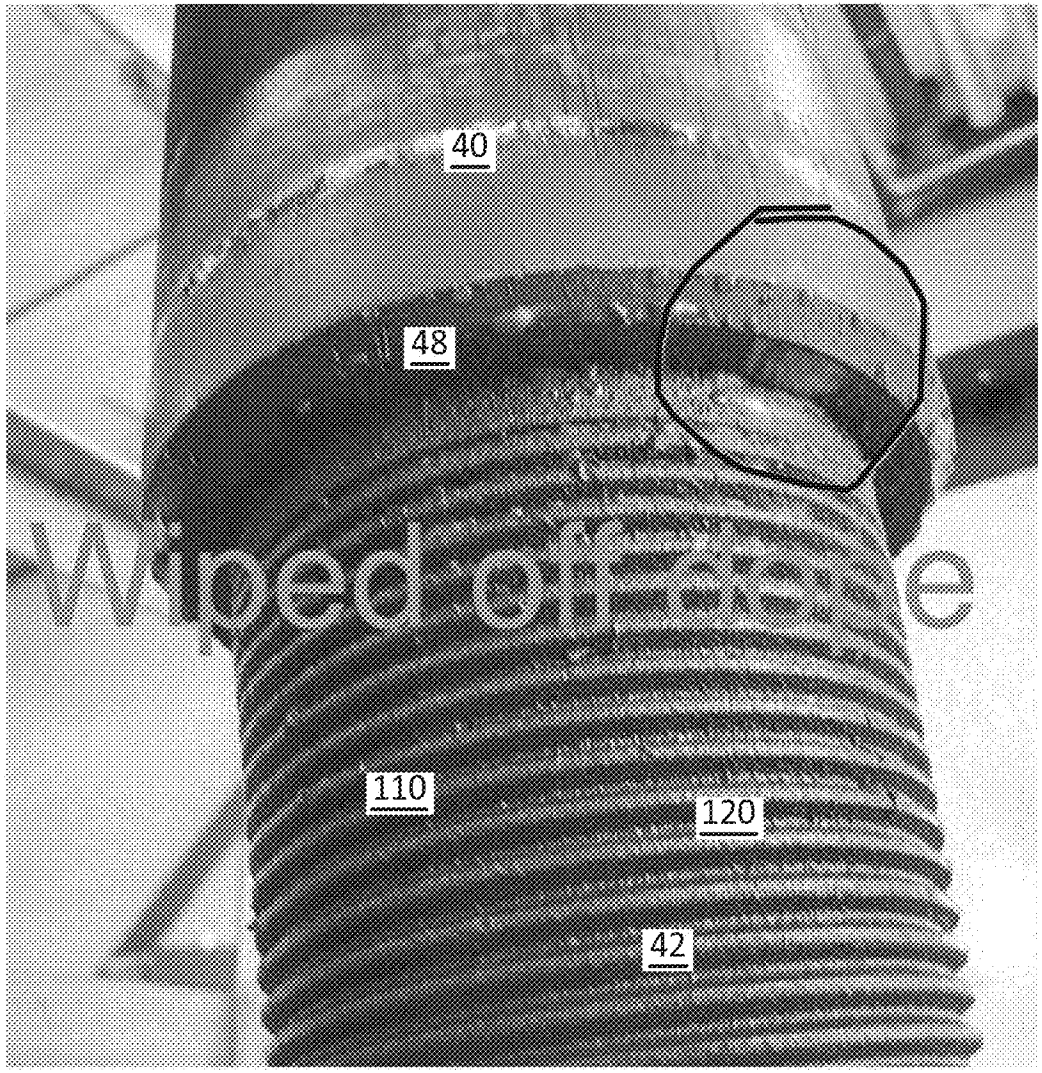
FIG. 7E is a representative perspective view of a pin end of a tubular that has been cleaned and doped by a doping device, in accordance with certain embodiments.

FIG. 7E is a representative perspective view of a pin end 42 of a tubular 40 that has been cleaned and doped by a doping device 50*a*. In this example, dope has been applied to the threads 120 and shoulders 48 of the pin end 42 to create a doping layer 110 on the threads 120 and the shoulder 48. The application of the dope to the threads 120 and the shoulder 48, including cleaning the threads 120 and shoulders 48 before applying the dope, took about 6 seconds, for this example configuration. FIG. 7E illustrates the uniformity of the doping layer 110 on the threads 120 and shoulders 48 as compared to the area where the dope was wiped away to demonstrate the thin but near uniform distribution of the dope on the threads 120 and the shoulders 48.

Figure 8B:
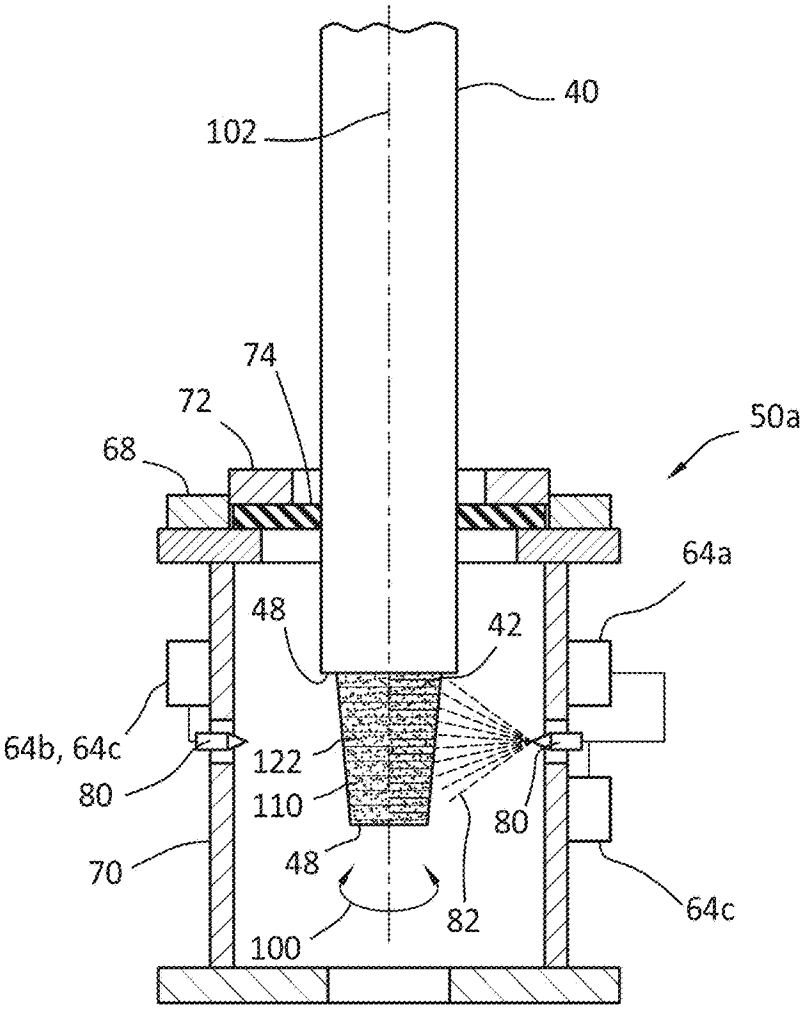
FIG. 8B is a representative partial cross-sectional view of the doping device of FIG. 8A doping the film covering the threads on the pin end after the pin end has been positioned within the doping device, in accordance with certain embodiments.
Figure 8A:
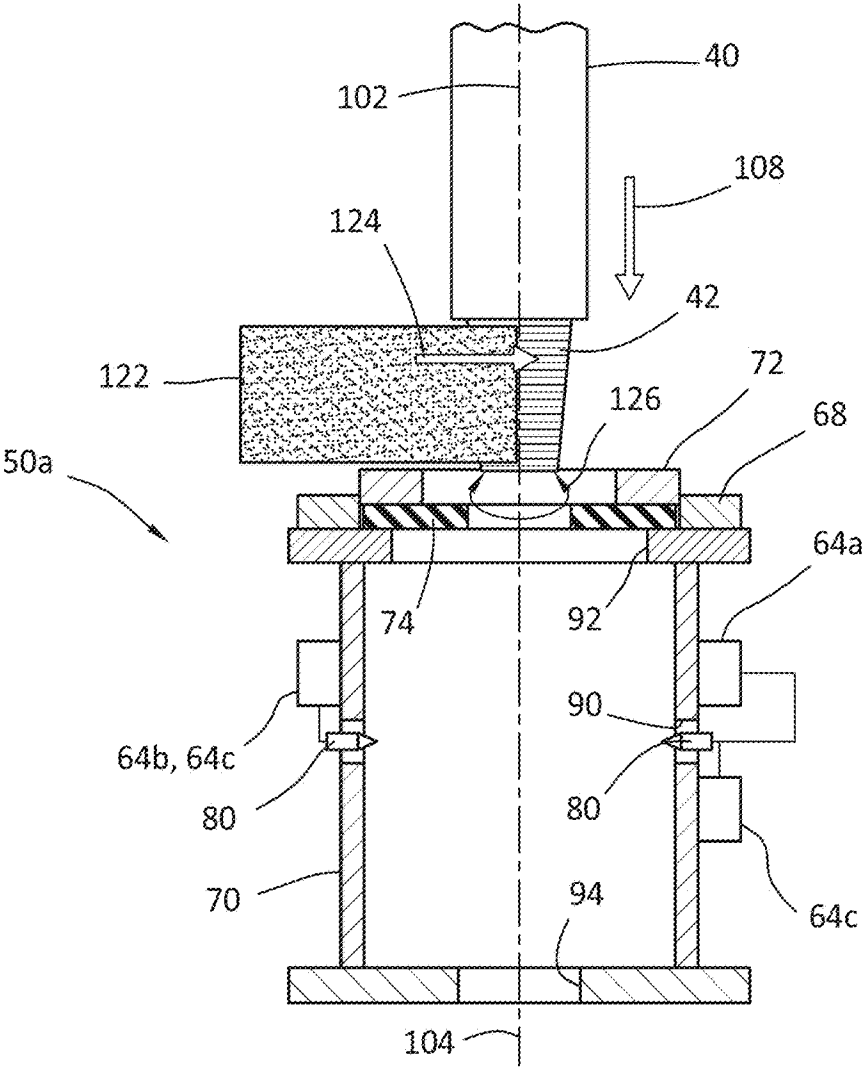
FIG. 8A is a representative partial cross-sectional view of a doping device for testing an application of dope to threads on a film covering a pin end of a tubular prior to the pin end being positioned within the doping device, in accordance with certain embodiments.

FIGS. 8A-8D illustrate a method for determining an average thickness value for an area of the dope applied to the threads 120 by the doping device 50*a*. It should be noted that a similar approach can be used to determine an average thickness value for an area of the dope applied to the threads 120 and shoulders 49 of a box end 44 by the doping device 50*b*. FIG. 8A shows a thin film material 122 that can be feed onto the threads 120 (arrow 124) and wrapped around the threads 120 of the pin end 42 (arrows 126) thereby covering a majority (preferably all) of the threads 120 prior to insertion of the pin end 42 into the doping device 50*a*.

FIG. 8B shows the threads 120 covered (or at least partially covered) by the thin film material 122, such that the majority (preferably all) of the dope 86 applied to the threads 120 (i.e. the thin film material 122 in this case) via the application of the air/dope mixture 88 by the spray pattern 82 as the tubular 40 is being rotated (arrows 100) by the pipe handler 20 is applied to the thin film material 122. When the controller 56 has enabled application of the air/dope mixture 88 to the thin film material 122 thereby depositing a layer of dope 110 onto the material 122, then the controller 56 can disable application of the air/dope mixture 88 through the nozzle 80, and the pipe handler 20 can remove the pin end 42 from the doping device 50*a*. The thin film material 122 can then be removed from the pin end 42 for analysis.

Figure 8C:
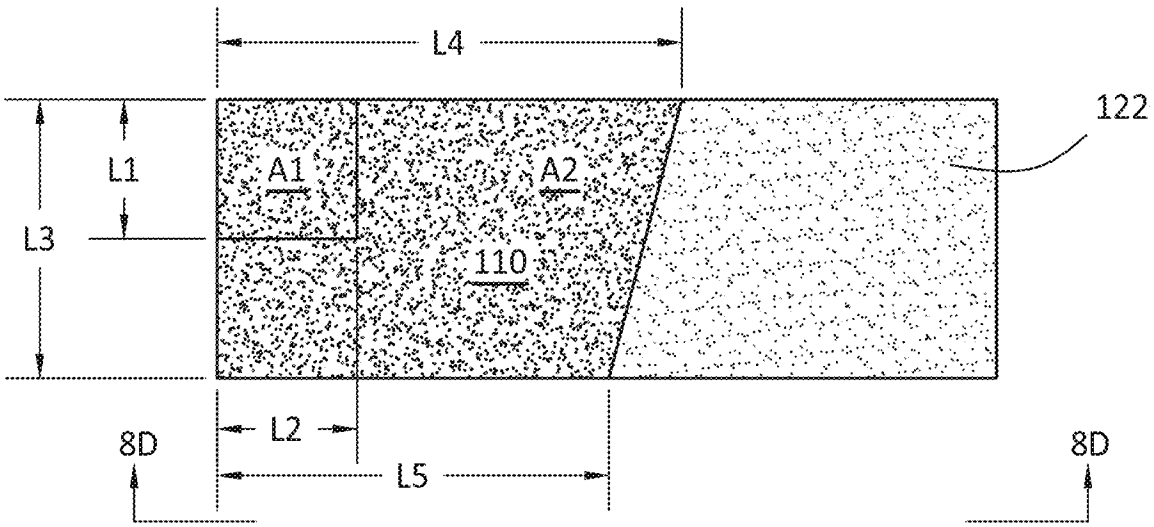
FIGS. 8C and 8D are representative top and side views of the film of FIG. 8A after the doping device has applied dope to the film as in FIG. 8B, in accordance with certain embodiments.
Figure 8D:
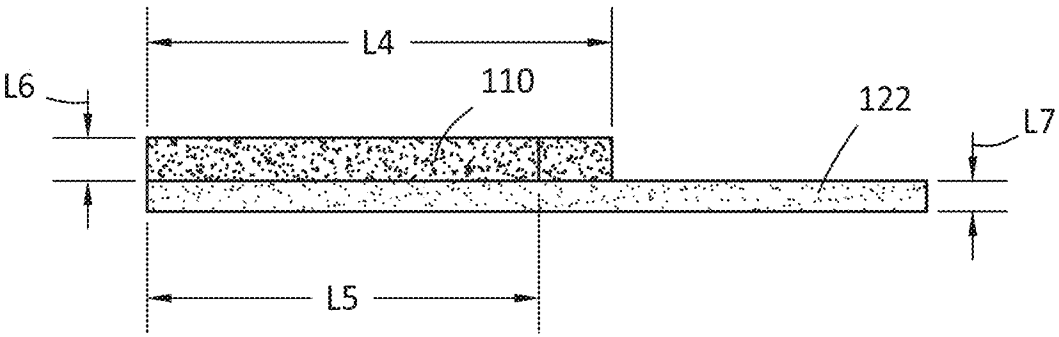

FIG. 8C is a representative view of the thin film material 122 after the doping layer 110 has been applied and after the material 122 has been removed from the pin end 42. The resulting shape of the doping layer 110 on the material 122 can be somewhat trapezoidally shaped, since the pin end 42 is tapered and the material being wrapped around the pin end 42 threads 120 may not produce a square doping layer 110. Regardless of the shape of the doping layer 110, the area A2 can be determined by measuring the resulting area of the doping layer 110. In the case of a trapezoidally shaped doping layer 110, the dimensions L3, L4, L5 can be measured and used to determine the area of the doping layer 110.

The amount of dope applied to the area A2 (which includes the smaller area A1) can be determined by measuring the change in weight of the thin film material 122 from before the test to the weight of the thin film material 122 (including the doping layer 110) after the test. The material 122 can be weighed prior to wrapping the threads 120 in preparation for a doping test. After the doping test is complete, the material 122 including the dope deposited during test can be unwrapped from the threads 120 and weighed again. The difference in weight is due to the deposited dope. The volume of the deposited dope can be determined from the weight of the deposited dope based on the known density of the dope.

Alternatively, or in addition to, the amount of dope applied to the area A2 (which includes the smaller area A1) can be determined by measuring the change in weight of a container from which dope is being collected during the application process. The weight of the container can be measured before and after the dope application process. The change in weight from before the dope application process to after the dope application process can be assumed to be the weight of dope applied to the pin end 42 during the dope application process. However, this method does not take into account dope that is lost to overspray and is not applied to the thin film material 122.

The determined weight of the deposited dope can be used to calculate the volume of dope applied to the pin end 42 (and thus equal to the dope applied to the thin film material 122) since the density of the dope is known. The average thickness of the dope applied across the thin film material 122 can be determined by dividing the volume of the dope that was applied to the thin film material by the area A2 of the thin film material 122 on which the dope was applied. With the volume of the applied dope being determined, the average thickness L6 of the dope layer 110 can be determined by dividing the volume of the applied dope by the area A1 of the thin film material 122 on which the dope was applied. The average thickness of the thin film material 122 is indicated as length L7.

The volume of dope applied to the thin film material 122 can also be determined by using the pressures P2, P3 applied to the air and dope, respectively, during the dope application process, the nozzle 80 used during the dope application process (e.g. see specs on example nozzles shown in FIG. 6E), and the duration the fluids (e.g. air and dope in this example) are applied to the pin end 42 through the nozzle 80. The nozzle specs can also be established by performing spray testing of the fluids through the selected nozzle 80 to determine the volume delivered through the nozzle over a period of time. This data can also be used to calculate the volume of dope applied to the pin end 42 during the dope application process.

An example test was performed using the principles disclosed regarding FIGS. 8A-8D. The dope used in this test was a BESTOLIFE™ 3010 NM special. However, other dope can be used for doping threads 120 on a tubular 40. The doping device 50*a* provided dope pressurized to 3.85 bar (55.8 psi). The nozzle 80 used in this test was a JBW1385 B31-BSP nozzle (refer to FIG. 6E for nozzle specifications) that can deliver 3 L/min of dope at 3.85 bar (55.8 psi). The revolutions per minute (RPM) of the tubular 40 during this test was 60. Between 6 and 7 grams of dope was applied to the threads of a 5" (127 mm) pin end 42. The weight of the thin film material 122 was ~3 grams. The weight of the thin film material 122 after the doping process was ~9 grams. The connection surface area (i.e. A2) of the pin end 42 was ~500 cm*2. The application of the dope produced a doping layer that was calculated to be less than 0.0045" (0.114 mm). The thickness (i.e. L6) of the doping layer 110 ranged from 0.0025" to 0.0045" (0.064 mm to 0.114 mm).

The application of the dope to the threads 120 and the shoulder 48, including cleaning the threads 120 and shoulders 48 before applying the dope, took about 6 seconds. The variables that drive the thickness of dope applied to the threads 120 and shoulders 48 can be: 1) the rotational speed (RPMs) of the tubular 40 during the application of the dope through the nozzle 80, 2) the nozzle 80 selected for the doping device 50*a*, 50*b*, 3) the pressure of the dope flowing through the nozzle 80, 4) the dope selected, and 5) the duration of application of the dope to the threads 120 and shoulders 48. The controller 56 can control the duration of application of the dope and the rotational speed of the tubular 40. The controller 56 can also control the pressure of the dope if the dope storage provides a controllable pressure capability that can be controlled by the controller 56. The controller 56 can use the specifications of a selected nozzle 80, the specifications of the selected dope, and the pressure of the selected dope to calculate and control the tubular rotational speed and the duration of the application of the dope. By controlling these variables, via operators or the controller 56, the thickness of dope applied to the threads 120 and shoulders 48 on an end of a tubular 40 can be tailored to achieve the desired result.

Testing for applying dope to the threads 120 and shoulder 48, 49 of the tubular 40 using the doping devices 50*a*, 50*b* has shown that the average thickness L6 of the dope on the thin film material 122 can be less than 3 mm, or less than 2.5 mm, or less than 2.0 mm, or less than 1.5 mm, or less than 1.0 mm, or less than 0.5 mm, or less than 0.4 mm, or less than 0.3 mm, or less than 0.2 mm, or less than 0.15 mm, or less than 0.12 mm.

Therefore, the area A1 can have an average thickness L6 of the doping layer 110, since the area A1 is a subset of the area A2. The average thickness L6 across the area A1 can be less than 3 mm, or less than 2.5 mm, or less than 2.0 mm, or less than 1.5 mm or less than 1.0 mm, or less than 0.5 mm, or less than 0.4 mm, or less than 0.3 mm, or less than 0.2 mm, or less than 0.15 mm, or less than 0.12 mm. The area A1 can be determined by multiplying length L1 by length L2, where L1 can be less than L3 and L2 can be less than L5.

Length L1 can be at least 10 mm, at least 20 mm, at least 30 mm, at least 40 mm, at least 50 mm, at least 60 mm, at least 70 mm, at least 80 mm, at least 90 mm, or at least 100 mm. Length L1 can also be represented as being at least 25%, or at least 30%, or at least 35%, or at least 40%, or at least 45%, or at least 50%, or at least 55%, or at least 60%, or at least 65%, or at least 70%, or at least 75%, or at least 80%, or at least 85%, or at least 90%, or at least 95%, or 100% of the axial length L3 of the doping layer 110.

Length L2 can be at least 10 mm, at least 20 mm, at least 30 mm, at least 40 mm, at least 50 mm, at least 60 mm, at least 70 mm, at least 80 mm, at least 90 mm, or at least 100 mm. Length L2 can also be represented as being at least 25%, or at least 30%, or at least 35%, or at least 40%, or at least 45%, or at least 50%, or at least 55%, or at least 60%, or at least 65%, or at least 70%, or at least 75%, or at least 80%, or at least 85%, or at least 90%, or at least 95%, or 100% of the circumferential length L5 of the doping layer 110 which can also refer to the circumferential length of the bottom of the threads 120 of the pin end 42. For the doping device 50*b*, length L4 can represent the circumferential length of the top of the internal threads 120 of the box end 44, and length L5 can represent the circumferential length of the bottom of the internal threads 120 of the box end 44.

Figure 9B:
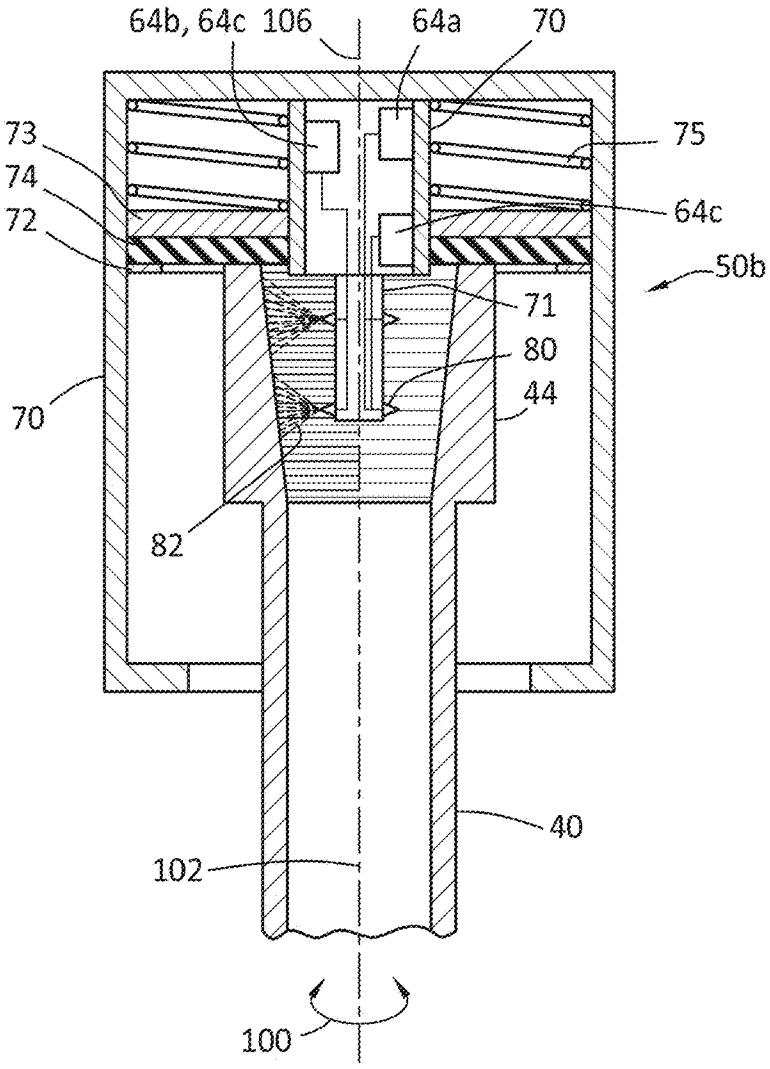
FIGS. 9B, 9C, and 9D are representative partial cross-sectional views of the doping device of FIG. 9A in various stages of doping the threads on the box end after the box end has been positioned within the doping device, in accordance with certain embodiments.
Figure 9A:
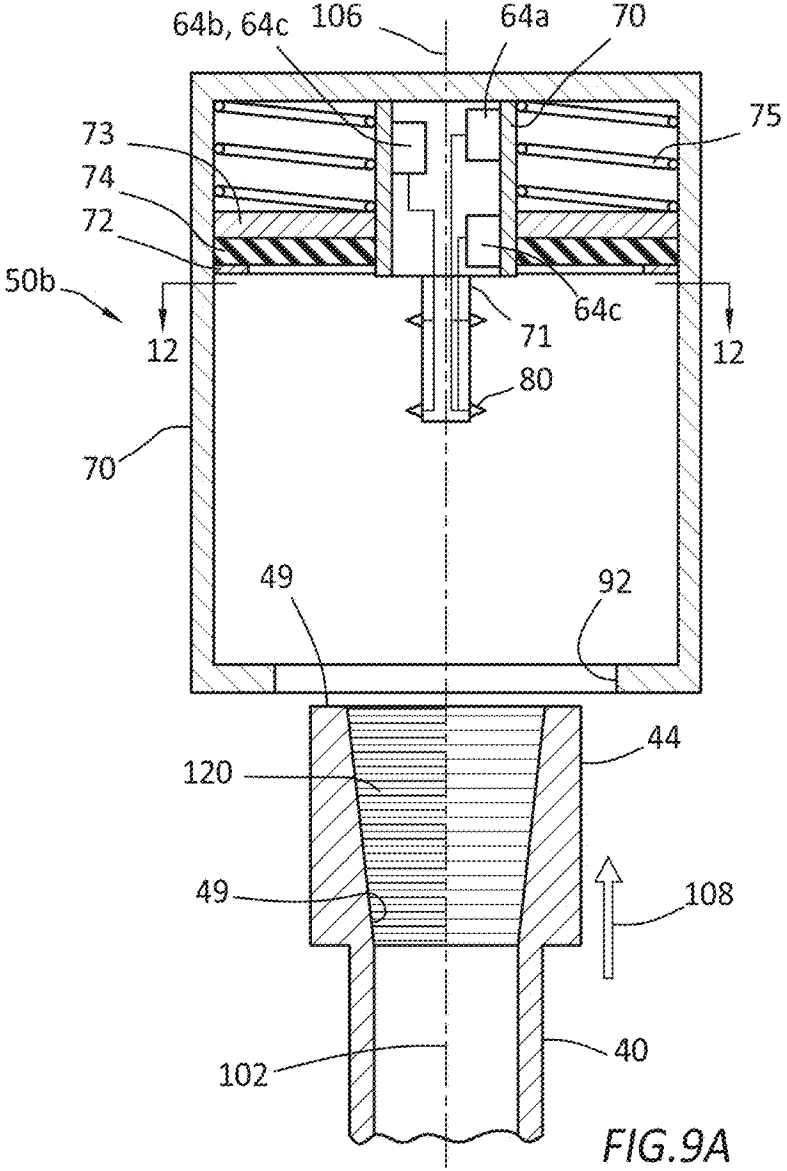
FIG. 9A is a representative partial cross-sectional view of another doping device for applying dope to threads on a box end of a tubular prior to the box end being positioned within the doping device, in accordance with certain embodiments.

FIG. 9A is a representative partial cross-sectional view of a doping device 50*b* for applying dope 86 to threads within a box end 44 of a tubular 40 prior to the box end 44 being positioned within the doping device 50*b*. A housing 70 can provide structural support for the valves, 64*a-c*, actuators 66*a-c*, and nozzles 80. The housing 70 can include a protrusion 71 that extends into a chamber of the doping device 50*b* and contains one or more nozzles 80 attached to the protrusion and directed radially away from a center axis 106 towards threads 120 of the box end 44. The nozzles 80 can spray fluids onto the threads 120 (and shoulder 49) of the box end 44 when it is positioned (or being positioned) within the chamber of the housing 70, and over the protrusion 71 and the nozzles 80.

The housing 70 can include an opening 92 at a bottom of the doping device 50*b* which allows access for the box end 44 to be inserted into the chamber of the housing 70 for cleaning and doping the threads 120. A seal 74 can be positioned around the protrusion 71 and can sealingly engage the box end 44 when the box end 44 is inserted (arrow 108) into the housing 70 through the opening 92 and into engagement with the seal 74. A center longitudinal axis 102 of the tubular 40 can be substantially aligned and/or substantially in parallel to a center axis 106 of the doping device 50*b*. However, the longitudinal axis 102 and the center axis 106 are not required to be aligned or substantially parallel to each other. It is understood, that the doping device 50*b* can still clean the threads 120 and apply dope to the threads 120 with the longitudinal axis 102 and the center axis 106 being somewhat out of alignment and not necessarily in parallel with each other. However, any misalignment or lack of parallelism between the axes 102, 106 must not prevent distribution of the fluids to the threads 120 by the spray pattern from the nozzle(s) 80.

Figure 12:
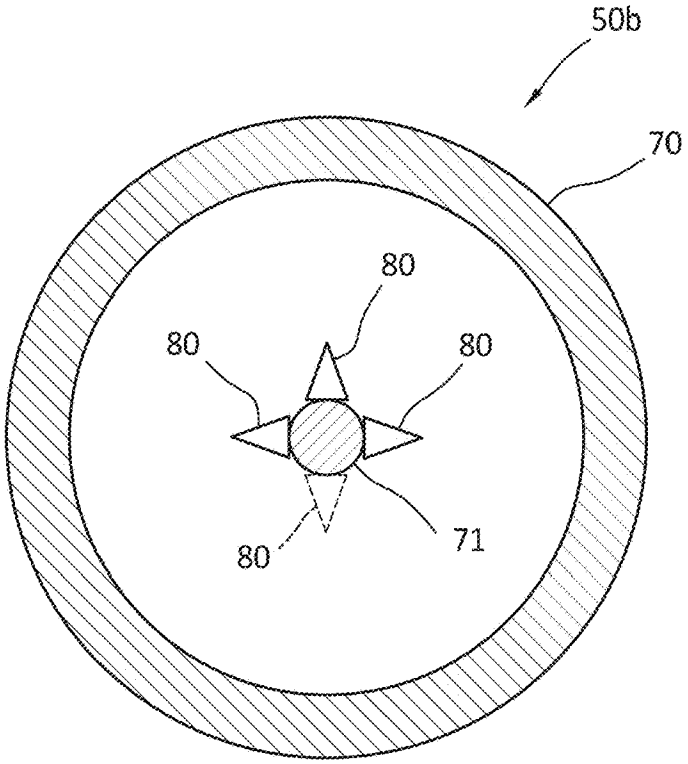
FIG. 12 is a representative partial cross-sectional view 12-12, as indicated in FIG. 9A, of a doping device for applying dope to threads on a box end of a tubular, in accordance with certain embodiments.

The nozzle 80 on the left side of the protrusion 71 can receive air or water from the respective valve 64*b*, 64*c* to deliver air or water to the box end 44. As described above related to FIGS. 6A, 6B, a fluid source (62*b* or 62*c*) can supply fluid to the nozzle 80 through a valve (64*b* or 64*c*, respectively). There can be two separate nozzles 80, with one nozzle 80 receiving water from the valve 64*b* and another nozzle 80 receiving air from a valve 64*c*. However, there can also be one nozzle 80 that selectively receives water from the valve 64*b* and air from a valve 64*c*. The nozzle 80 on the right side of the protrusion 71 can be configured as indicated in FIGS. 6C, 6D, with one nozzle 80 receiving an air/dope mixture 88 from the valves 64*a*,64*c*. The nozzles 80 can be distributed around the protrusion 71 in various other circumferential positions. The two nozzles are shown 180 degrees offset from each other for discussion purposes only. FIG. 12 shows other example nozzle configurations, with other nozzle configurations being envisioned as well, such as nozzles offset 60 degrees from each other, or 45 degrees from each other, etc.

The doping device 50*b* is configured to accommodate various types of tubulars 40 as well as various sizes of the various types. The larger size tubulars, such as casing, as well as the smaller size tubulars, such as smaller diameter drill pipe, can be cleaned and doped by the doping device, without adjusting the positions of the nozzles in the doping device 50*b*. For example, the size of tubulars 40 can include, but not limited to, 2⅜", 2⅞", 3½", 4", 4½", 5", 5½", 6⅝", 7", 7⅝", 8⅝", 8⅝", 9⅝", 10¾", 11¾", 13⅜", 16", 18⅝", and 20" diameter tubing.

FIG. 9B is a representative partial cross-sectional view of the doping device 50*b* of FIG. 9A performing a cleaning operation on the threads 120 of the box end 44. The controller 56 has enabled the flow of fluid (e.g. water) to the nozzle 80 at a pressure of P2 by controlling a respective actuator 66 while the tubular 40 is being rotated (arrows 100) by the pipe handler 20. The seal 74 can be configured to rotate with the tubular 40 while engaged with the tubular 40 or it can remain stationary relative to the housing 70 and rotate relative to the tubular 40. The retainers 72, 73 can be used to hold the seal 74 in place. In this example, the retainer 73 is biased, via biasing device 75, toward the seal 74, the retainer 72, and the box end 44. When the box end 44 engages the seal 74, the biasing device 75 acts to resist movement of the seal 74 away from the retainer 72 and applies a biasing force against the seal 74 thereby maintaining engagement of the seal 74 with the box end 44. This configuration of the doping device 50*b* can contain over spray of fluids from the nozzles 80 within the box end 44.

In FIG. 9B, the fluid can be water that is applied to the threads 120 via the spray pattern 82 to clean the threads 120 of old dope, debris, or other contaminants. The excess fluid can drain down the inside of the tubular 40.

Figure 9D:
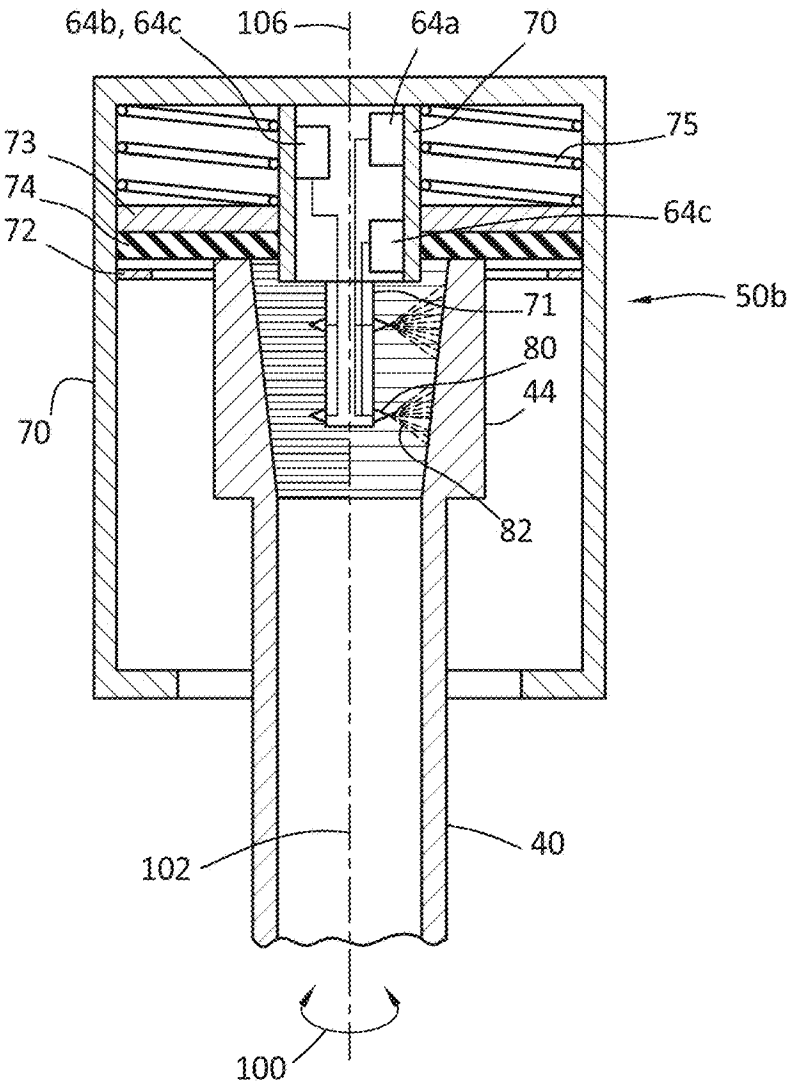
Figure 9C:
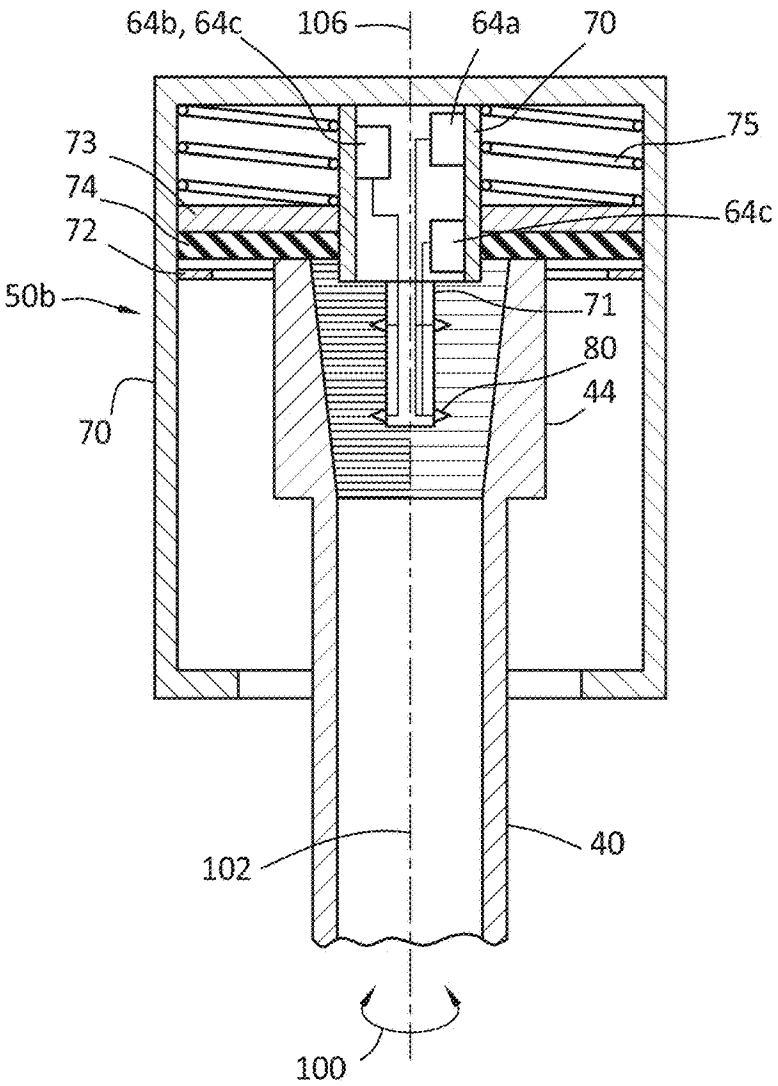

FIG. 9C is a representative partial cross-sectional view of the doping device 50*b* of FIG. 9A performing a drying operation of the threads 120 of the box end 44. The controller 56 has enabled the flow of fluid (e.g. air) to a nozzle 80 (not shown) at a pressure of P2 by controlling a respective actuator 66 while the tubular 40 is being rotated (arrows 100) by the pipe handler 20. In FIG. 9C, the fluid can be air that is applied to the threads 120 via the spray pattern 82 to dry the threads 120 after being cleaned by the water.

FIG. 9D is a representative partial cross-sectional view of the doping device 50*b* of FIG. 9A performing a doping operation on the threads 120 of the box end 44. The controller 56 has enabled the flow of two fluids (e.g. air and dope) to the nozzle 80 at a respective pressure of P2, P3 by controlling respective actuators 66 while the tubular 40 is being rotated (arrows 100) by the pipe handler 20. In FIG. 9D, the fluids can be air and dope, with the dope being impinged by the air at an angle to atomize the dope to produce an air/dope mixture, with the air/dope mixture being applied to the threads 120, via the spray pattern 82, to dope the threads 120. A generally uniform distribution of the dope on the area of the threads 120 is provided by the doping device 50*b*.

Figure 10B:
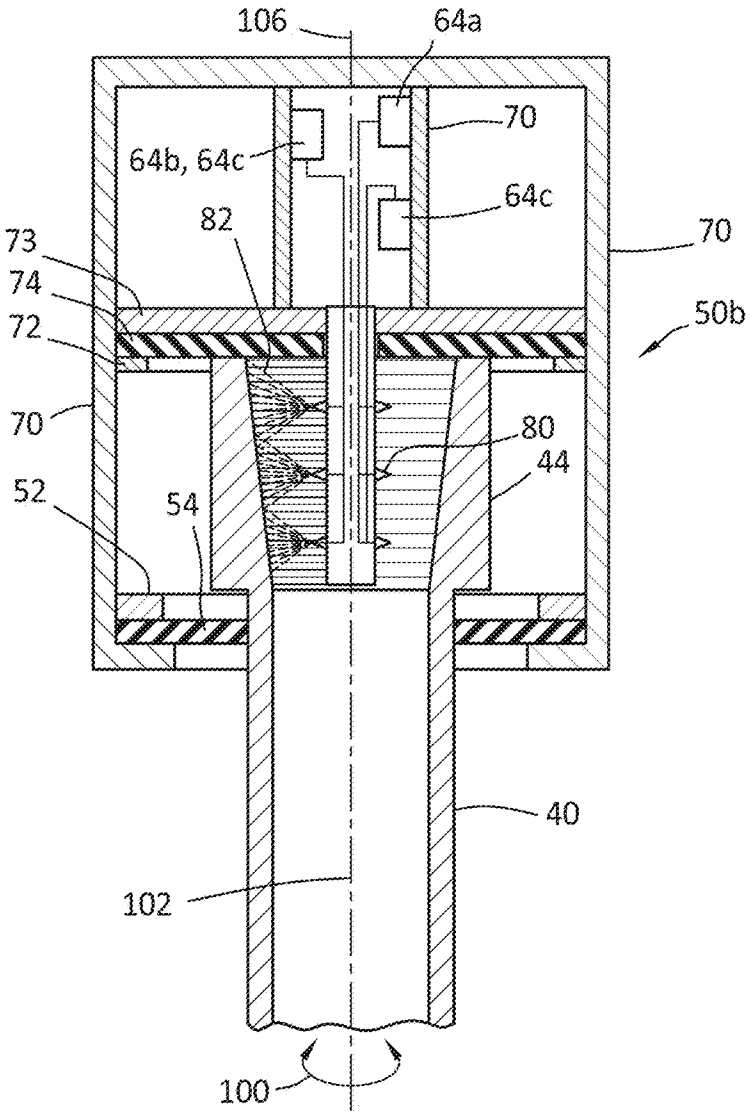
FIGS. 10B, 10C, and 10D are representative partial cross-sectional views of the doping device of FIG. 10A in various stages of doping the threads on the box end after the box end has been positioned within the doping device, in accordance with certain embodiments.
Figure 10A:
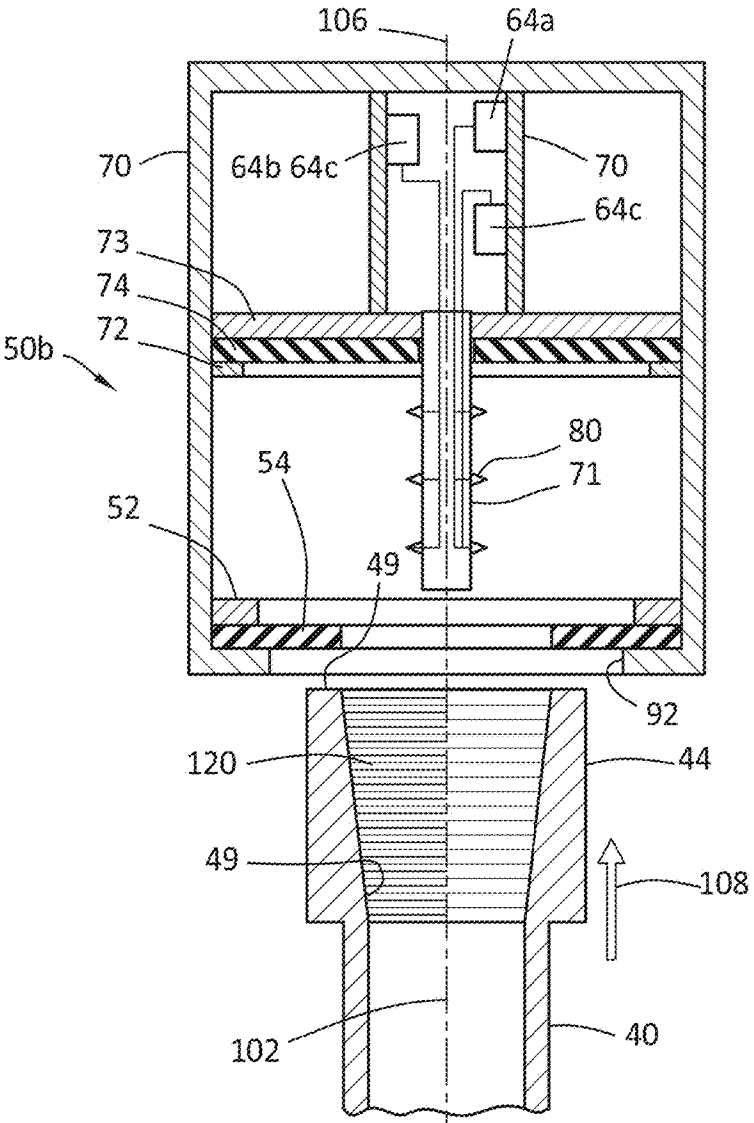
FIG. 10A is a representative partial cross-sectional view of another doping device for applying dope to threads on a box end of a tubular prior to the box end being positioned within the doping device, in accordance with certain embodiments.

FIG. 10A is a representative partial cross-sectional view of another configuration of the doping device 50*b* for applying dope 86 to threads within a box end 44 of a tubular 40 prior to the box end 44 being positioned within the doping device 50*b*. A housing 70 can provide structural support for the valves, 64*a-c*, actuators 66*a-c*, and nozzles 80. The housing 70 can include a protrusion 71 that extends into a chamber of the doping device 50*b* and contains one or more nozzles 80 attached to the protrusion and directed radially away from a center axis 106 towards threads 120 of the box end 44. The nozzles 80 can spray fluids onto the threads 120 (and shoulder 49) of the box end 44 when it is positioned (or being positioned) within the chamber of the housing 70, and over the protrusion 71 and the nozzles 80.

The housing 70 can include an opening 92 at the bottom of the doping device 50*b* which allows access for the box end 44 to be inserted into the chamber of the housing 70 for cleaning and doping the threads 120. A seal 54 with retainer 52 can be positioned around the opening 92. The seal 54 can engage the tubular 40 when the box end 44 is inserted (arrow 108) into the chamber of the housing 70 through the opening 92. A seal 74 can be positioned around the protrusion 71 and can sealingly engage the box end 44 when the box end 44 is inserted into the housing 70 through the opening 92 and into engagement with the seal 74. A center longitudinal axis 102 of the tubular 40 can be substantially aligned and/or substantially in parallel to a center axis 106 of the doping device 50*b*. However, the longitudinal axis 102 and the center axis 106 are not required to be aligned or substantially parallel to each other. It is understood, that the doping device 50*b* can still clean the threads 120 and apply dope to the threads 120 with the longitudinal axis 102 and the center axis 106 being somewhat out of alignment and not necessarily in parallel with each other. However, any misalignment or lack of parallelism between the axes 102, 106 must not prevent distribution of the fluids to the threads 120 by the spray pattern from the nozzle(s) 80.

The nozzle 80 on the left side of the protrusion 71 can receive air or water from the respective valve 64*b*, 64*c* to deliver air or water to the box end 44. As described above related to FIGS. 6A, 6B, a fluid source (62*b* or 62*c*) can supply fluid to the nozzle 80 through a valve (64*b* or 64*c*, respectively). There can be two separate nozzles 80, with one nozzle 80 receiving water from the valve 64*b* and another nozzle 80 receiving air from a valve 64*c*. However, there can also be one nozzle 80 that selectively receives water from the valve 64*b* and air from a valve 64*c*. The nozzle 80 on the right side of the protrusion 71 can be configured as indicated in FIGS. 6C, 6D, with one nozzle 80 receiving an air/dope mixture 88 from the valves 64*a*,64*c*. The nozzles 80 can be distributed around the protrusion 71 in various other circumferential positions. The two nozzles are shown 180 degrees offset from each other for discussion purposes only. FIG. 12 shows other example nozzle configurations, with other nozzle configurations being envisioned as well, such as nozzles offset 60 degrees from each other, or 45 degrees from each other, etc.

The doping device 50*b* is configured to accommodate various types of tubulars 40 as well as various sizes of the various types. The larger size tubulars, such as casing, as well as the smaller size tubulars, such as smaller diameter drill pipe, can be cleaned and doped by the doping device, without adjusting the positions of the nozzles in the doping device 50*b*. For example, the size of tubulars 40 can include, but not limited to, 2⅜", 2⅞", 3½", 4", 4½", 5", 5½", 6⅝", 7", 7⅝", 8⅝", 8⅝", 9⅝", 10¾", 11¾", 13⅜", 16", 18⅝", and 20" diameter tubing.

FIG. 10B is a representative partial cross-sectional view of the doping device 50*b* of FIG. 10A performing a cleaning operation on the threads 120 of the box end 44. The controller 56 has enabled the flow of fluid (e.g. water) to the nozzle 80 at a pressure of P2 by controlling a respective actuator 66 while the tubular 40 is being rotated (arrows 100) by the pipe handler 20. The seal 74 can be configured to rotate with the tubular 40 while engaged with the tubular 40 or it can remain stationary relative to the housing 70 and rotate relative to the tubular 40. The retainers 72, 73 can be used to hold the seal 74 in place. In this example, the retainer 73 is stationary and not biased toward the seal 74. When the box end 44 engages the seal 74, the retainer 73 causes the seal 74 to be in compression, thereby maintaining a sealing engagement between the seal 74 and the box end 44. This configuration of the doping device 50*b* can contain over spray of fluids from the nozzles 80 within the box end 44.

In FIG. 10B, the fluid can be water that is applied to the threads 120 via the spray pattern 82 to clean the threads 120 of old dope, debris, or other contaminants. The excess fluid can drain down the inside of the tubular 40.

Figure 10D:
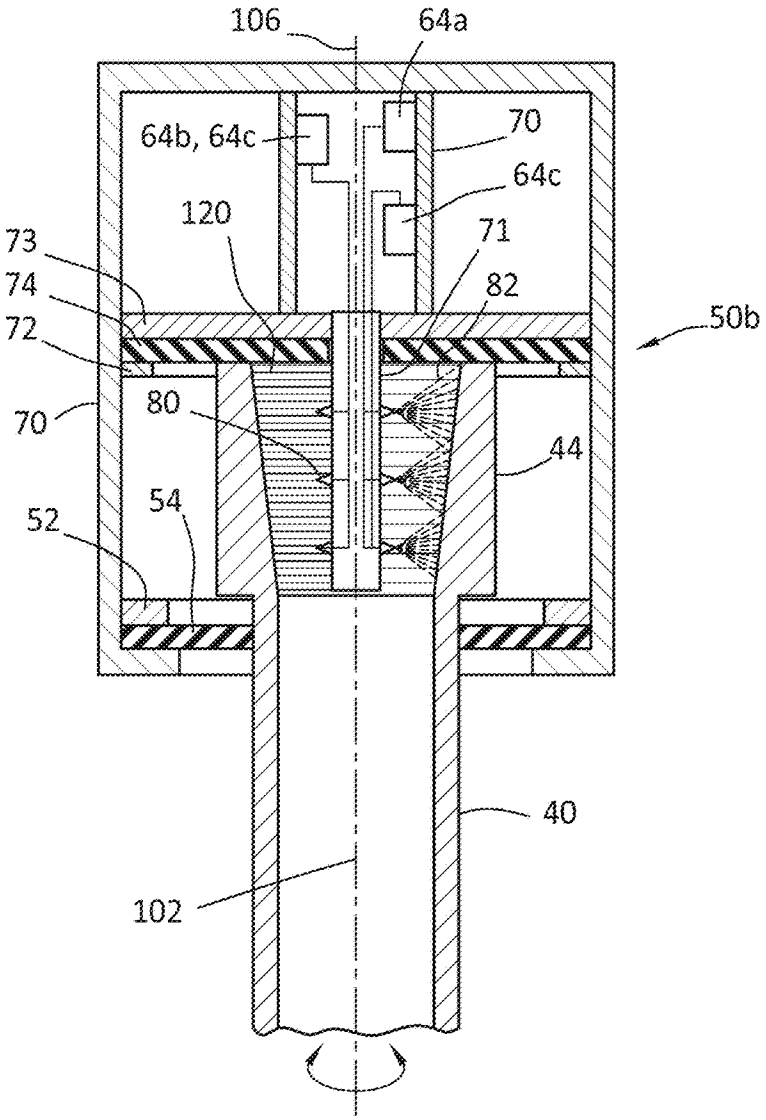
Figure 10C:
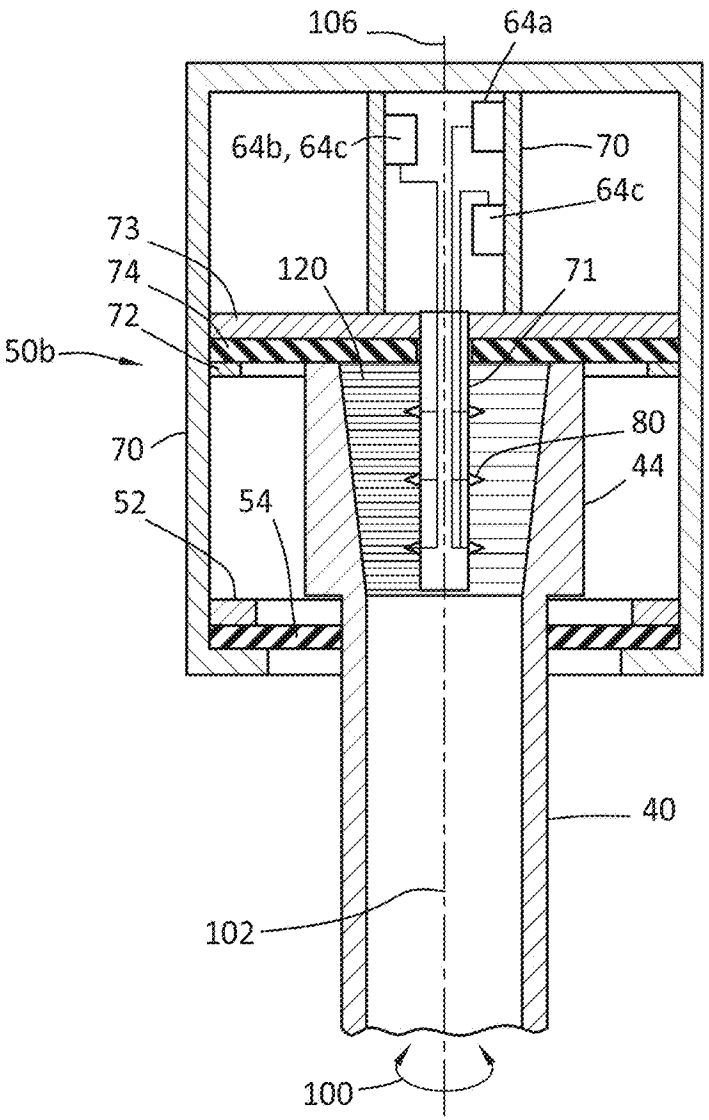

FIG. 10C is a representative partial cross-sectional view of the doping device 50*b* of FIG. 10A performing a drying operation of the threads 120 of the box end 44. The controller 56 has enabled the flow of fluid (e.g. air) to a nozzle 80 (not shown) at a pressure of P2 by controlling a respective actuator 66 while the tubular 40 is being rotated (arrows 100) by the pipe handler 20. In FIG. 10C, the fluid can be air that is applied to the threads 120 via the spray pattern 82 to dry the threads 120 after being cleaned by the water.

FIG. 10D is a representative partial cross-sectional view of the doping device 50*b* of FIG. 10A performing a doping operation on the threads 120 of the box end 44. The controller 56 has enabled the flow of two fluids (e.g. air and dope) to the nozzle 80 at a respective pressure of P2, P3 by controlling respective actuators 66 while the tubular 40 is being rotated (arrows 100) by the pipe handler 20. In FIG. 10D, the fluids can be air and dope, with the dope being impinged by the air at an angle to atomize the dope to produce an air/dope mixture, with the air/dope mixture being applied to the threads 120, via the spray pattern 82, to dope the threads 120. A generally uniform distribution of the dope on the area of the threads 120 is provided by the doping device 50*b*.

FIG. 11 is a representative partial cross-sectional view 11-11, as indicated in FIG. 7A, of a doping device 50*a* for applying dope 86 to threads 120 (and a shoulder 48) on a pin end 42 of a tubular 40. Four openings 90 are shown and each of these openings 90 can accommodate a nozzle 80. The bottom nozzle 80 is shown as being optional, but other nozzles can also be optional. The left nozzle 80 and the upper nozzle 80 can be used to deliver either water or air or both. It should be understood that any of the nozzle positions can deliver any of the fluid types. They are not restricted to the fluid types mentioned in this discussion of this example configuration. More or fewer openings 90 can be included in the wall of the housing 70 to accommodate more or fewer nozzles 80. The right opening 90 contains the nozzle 80 that can receive an air/dope mixture 88 from the valves 64*a*, 64*c*, with the air impinging on the dope to create the air/dope mixture 88.

FIG. 12 is a representative partial cross-sectional view 12-12, as indicated in FIG. 9A, of a doping device 50*b* for applying dope 86 to threads 120 (and the shoulder 49) on a box end 44 of a tubular 40. Four possible nozzle 80 positions are shown spaced circumferentially around the protrusion 71 of the housing 70. The bottom nozzle 80 is shown as being optional, but other nozzles can also be optional. The left nozzle 80 and the upper nozzle 80 can be used to deliver either water or air or both. It should be understood that any of the nozzle positions can deliver any of the fluid types. They are not restricted to the fluid types mentioned in this discussion of this example configuration. More or fewer nozzles 80 can be positioned around the protrusion 71 and along the protrusion 71. The right nozzle 80 can receive an air/dope mixture 88 from the valves 64*a*, 64*c*, with the air impinging on the dope to create the air/dope mixture 88.

Figure 13:
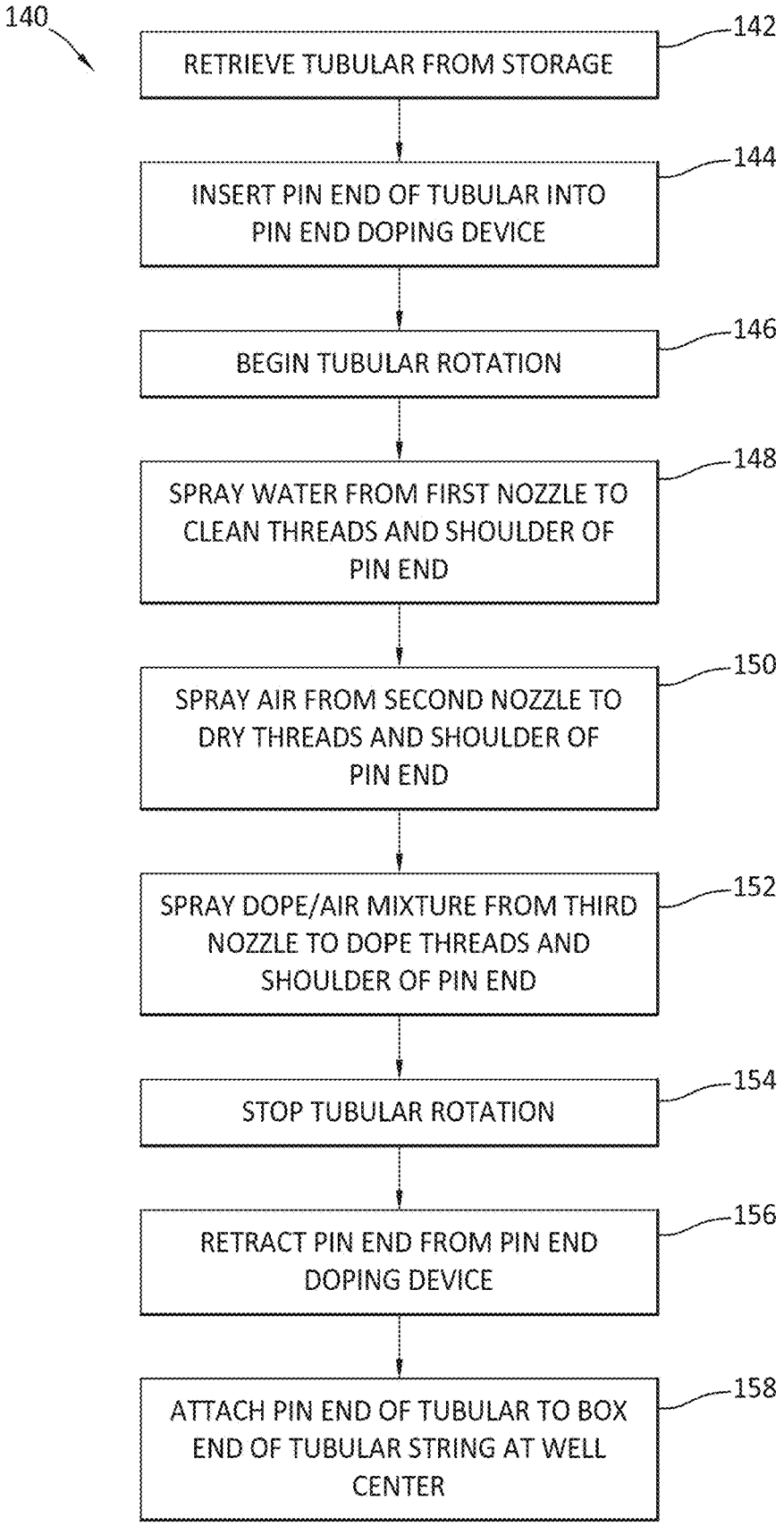
FIG. 13 is a flow diagram of a method for doping threads on a pin end of a tubular, in accordance to certain embodiments.

FIG. 13 is a flow diagram of a method 140 for doping threads and a shoulder of a pin end 42 of a tubular 40. In operation 142, the pipe handler 20 can retrieve a tubular 40 from a tubular storage (vertical, horizontal, etc.) and orient the tubular 40 in a position (e.g. vertical, inclined, or horizontal) in preparation for inserting the pin end 42 into the pin end doping device 50*a*. In operation 144, the pipe handler 20 can insert the pin end 42 into the pin end doping device 50*a*. In operation 146, the pipe handler 20 can begin rotating the tubular 40. In operation 148, while the tubular 40 is rotating, the controller 56 can enable a flow of water through a nozzle 80 to create a spray pattern 82 of water to clean the threads 120 and shoulders 48 of the pin end 42. In operation 150, while the tubular 40 is rotating, the controller 56 can disable the flow of water and enable the flow of air through a nozzle 80 to create a spray pattern 82 of air to dry the threads 120 and shoulders 48 of the pin end 42. In operation 152, while the tubular 40 is rotating, the controller 56 can disable the flow of air and enable the flow of air and dope to create an air/dope mixture 88 as described above, and drive the mixture 88 through a nozzle 80 to create a spray pattern 82 of the air/dope mixture to apply dope to the threads 120 and shoulders 48 of the pin end 42. The speed of the tubular 40 rotation and the pressures driving the air/dope mixture 88 (as well as the other variables mentioned above) can be adjusted to optimize the delivery of dope to the threads 120 and shoulders 48 in a layer with a substantially uniform thickness. As used herein, "substantially uniform thickness" refers to a thickness of the layer that is less than 3 mm, or less than 2.5 mm, or less than 2.0 mm, or less than 1.5 mm, or less than 1.0 mm, or less than 0.5 mm, or less than 0.4 mm, or less than 0.3 mm, or less than 0.2 mm, or less than 0.15 mm, or less than 0.12 mm. The variables that drive the thickness of dope applied to the threads 120 can be: 1) the rotational speed (RPMs) of the tubular 40 during the application of the dope through the nozzle 80, 2) the nozzle selected for the doping device 50*a*, 50*b*, 3) the pressure of the dope flowing through the nozzle 80, 4) the dope selected, and 5) the duration of application of the dope to the threads 120. In operation 154, the controller 56 can disable the flow of the air/dope mixture and (via the pipe handler 20) can stop the rotation of the tubular 40. In operation 156, the pipe handler 20 can remove the pin end 42 from the doping device 50*a*. In operation 158, the pipe handler 20 can deliver the tubular 40 with the doped threads 120 and shoulders 48 to the well center to connect the tubular 40 to a tubular string 46 that is positioned at the well center 18, or to a top drive or iron roughneck or other pipe handler to connect the tubular 40 to the tubular string 46 at the well center 18.

Figure 14:
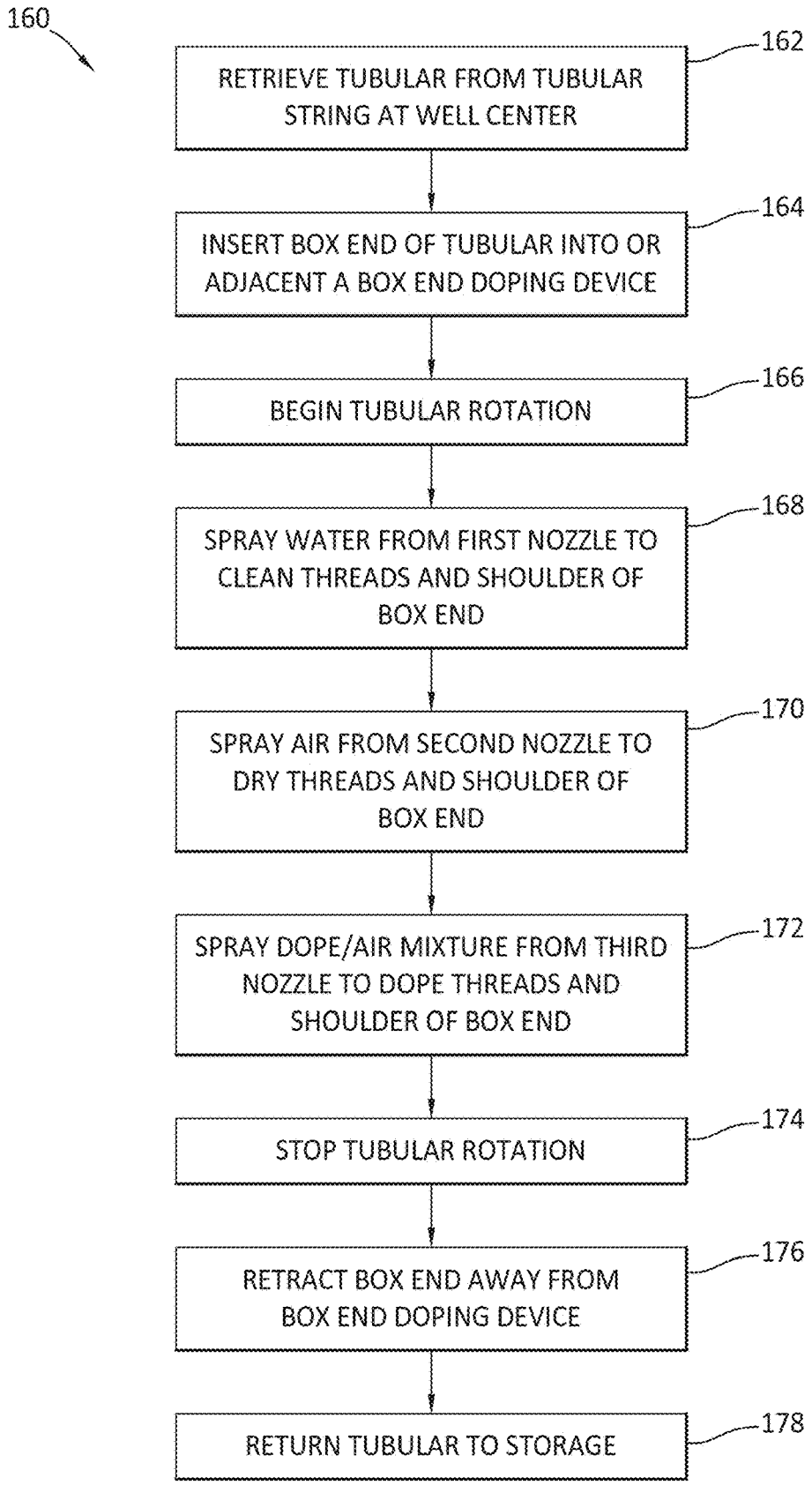
FIG. 14 is a flow diagram of a method for doping threads on a box end of a tubular, in accordance to certain embodiments.

FIG. 14 is a flow diagram of a method 160 for doping threads 120 within a box end 44 of a tubular 40. In operation 162, the pipe handler 20 can retrieve a tubular 40 from a tubular string 46 that is positioned at the well center (or from another pipe hander, or roughneck, or top drive) and orient the tubular 40 in a position (e.g. vertical, inclined, or horizontal) in preparation for inserting the box end 44 into the box end doping device 50*b*. In operation 164, the pipe handler 20 can insert the box end 44 into the doping device 50*b* or position the box end 44 proximate the doping device 50*b*. In operation 166, the pipe handler 20 can begin rotating the tubular 40. In operation 168, while the tubular 40 is rotating, the controller 56 can enable a flow of water through a nozzle 80 to create a spray pattern 82 of water to clean the threads 120 and shoulders 49 of the box end 44. In operation 170, while the tubular 40 is rotating, the controller 56 can disable the flow of water and enable the flow of air through a nozzle 80 to create a spray pattern 82 of air to dry the threads 120 and shoulders 49 of the box end 44. In operation 172, while the tubular 40 is rotating, the controller 56 can disable the flow of air and enable the flow of air and dope to create an air/dope mixture 88 as described above, and drive the mixture 88 through a nozzle 80 to create a spray pattern 82 of the air/dope mixture to apply dope to the threads 120 and shoulders 49 of the box end 44. The speed of the tubular 40 rotation and the pressures driving the air/dope mixture 88 can be adjusted to optimize the delivery of dope to the threads 120 and shoulders 49 in a layer with a substantially uniform thickness. In operation 174, the controller 56 can disable the flow of the air/dope mixture and (via the pipe handler 20) can stop the rotation of the tubular 40. In operation 176, the pipe handler 20 can remove the box end 44 away from the doping device 50*b*. In operation 178, the pipe handler 20 can deliver the tubular 40 with the doped threads 120 to a tubular storage (vertical, horizontal, etc.).

Figure 15:
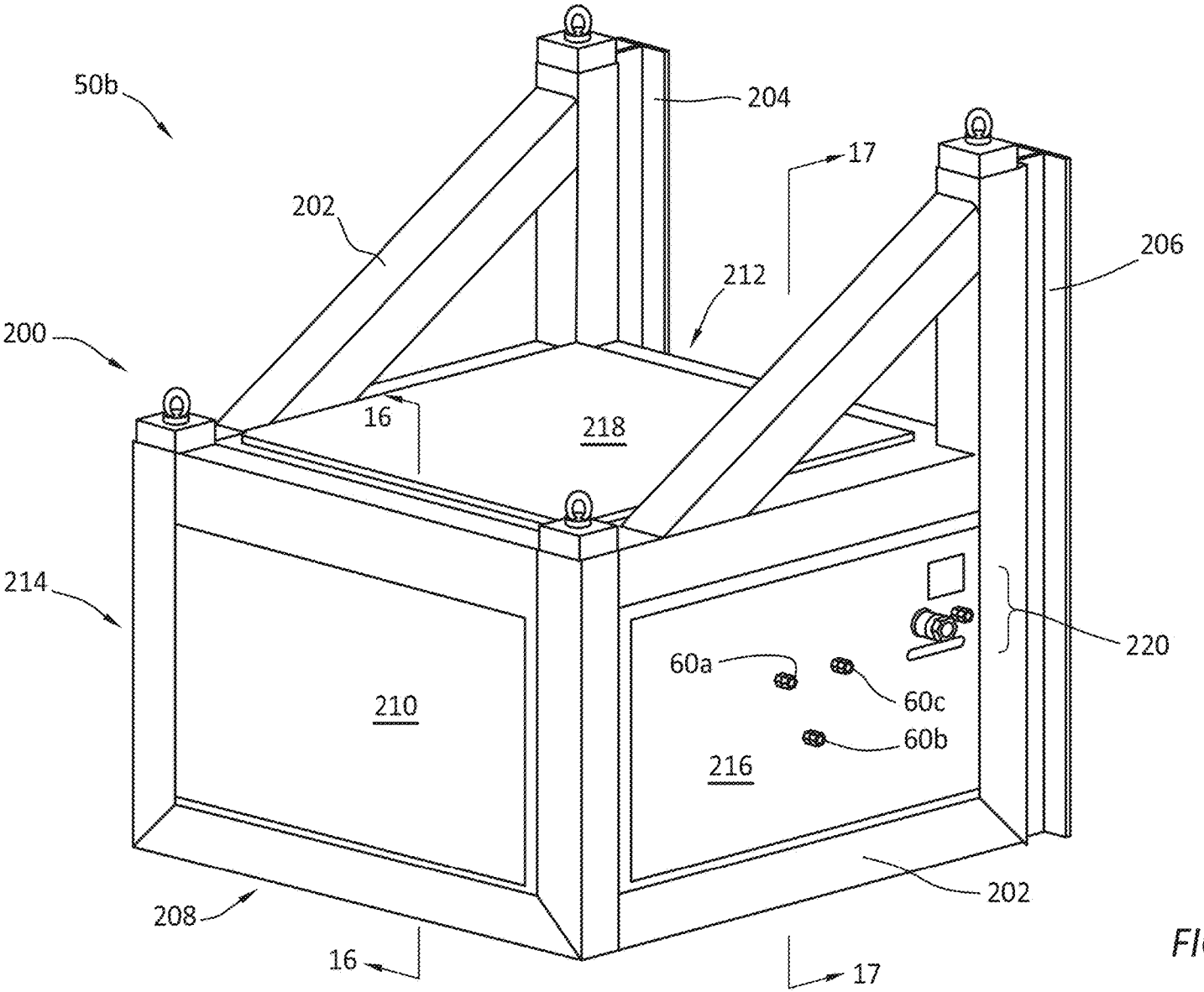
FIG. 15 is a perspective view of a doping device for doping a box end of a tubular, in accordance to certain embodiments.

FIG. 15 is a perspective view of a doping device 50*b* for doping a box end 44 of a tubular 40. The doping device 50*b* can include a housing 200 that forms an enclosure for containing nozzles 80, supply lines to the nozzles 80, valves for the supply lines, and other support equipment, including a controller 230. The housing 200 can include a frame 202 made up of various supports, and cover plates attached to all sides of the housing 200. For example, a cover plate 210 can be installed on the front side of the housing 200, a cover plate 212 can be installed on the back side of the housing 200, a cover plate 214 can be installed on the left side of the housing 200, a cover plate 216 can be installed on the right side of the housing 200, a cover plate 218 can be installed on the top side of the housing 200, and a cover plate 208 can be installed on the bottom side of the housing 200. The cover plates, when installed on the housing 200, and provide a sealed enclosure for containing and protecting the components of the doping device 50*b* (i.e. nozzles, valves, controller, etc.).

The housing 200 can be mounted to a rig 10 or other suitable structure at a well site (e.g. horizontal storage area structures, etc.) using the mounts 204, 206. Mounts 204, 206 can be used to secure the housing to a structure in any orientation between 0 "zero" degrees and 180 degrees relative to the rig floor 16 and in any azimuthal orientation relative to the Z-axis, which is perpendicular to the rig floor 16. One or more of the cover plates (e.g. 216) can be used as a bulkhead for providing connections to fluid sources, as well as electrical connections 220 (e.g. for power and communication signals). Dope 86 can be supplied to the doping device 50*b* via the connection 60*a*. Water 84 can be supplied to the doping device 50*b* via the connection 60*b*. Air 84 can be supplied to the doping device 50*b* via the connection 60*c*. The supply lines and valves can be similar to the previously described configurations to supply water 84, air 84, and an air/dope mixture 88 to the threads 120 and a shoulders 49 of the box end 44 of the tubular 40.

Figure 16:
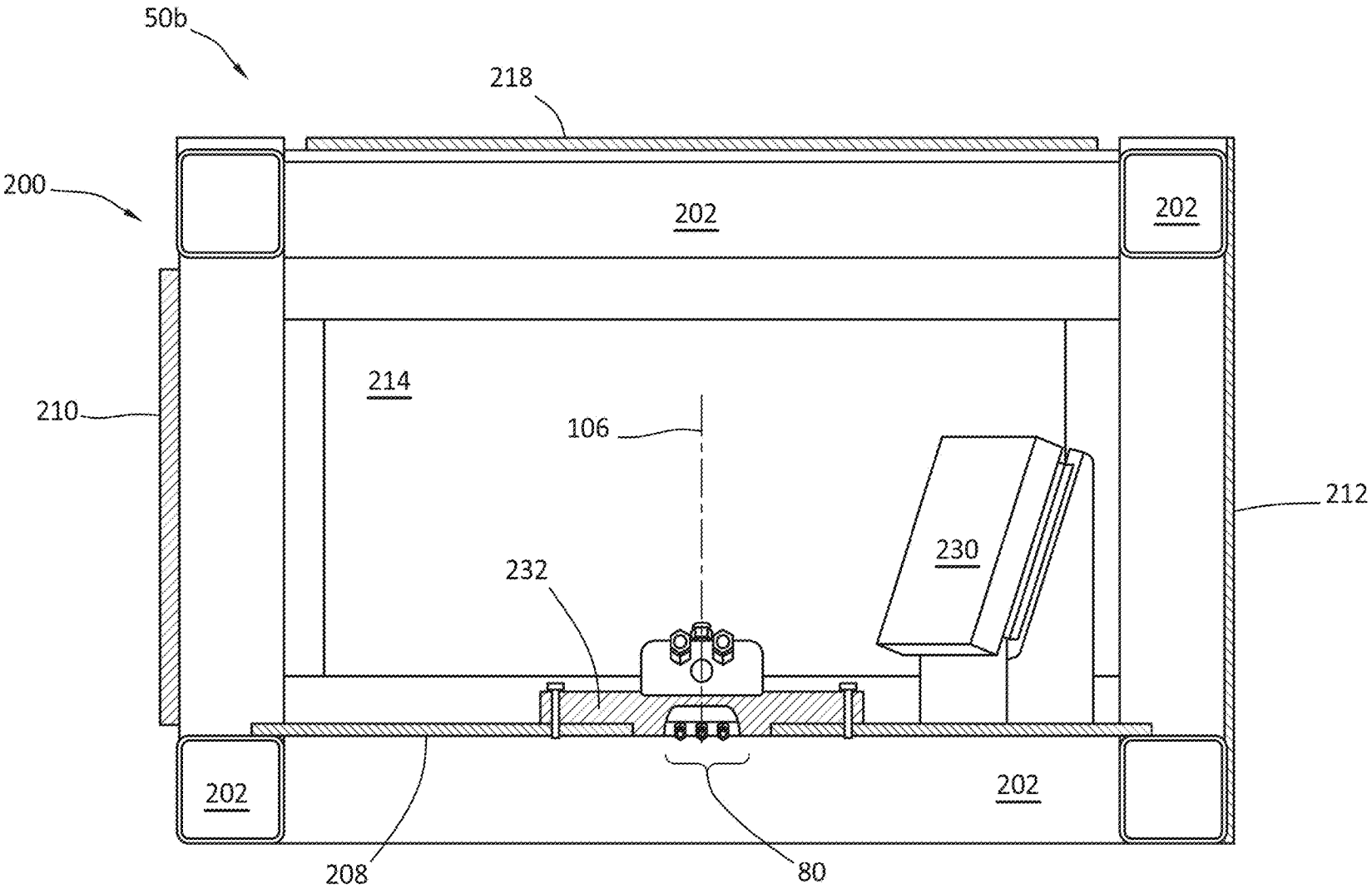
FIG. 16 is a partial cross-sectional view along cross section line 16-16 of the doping device shown in FIG. 15, in accordance to certain embodiments.

FIG. 16 is a partial cross-sectional view along cross section line 16-16 of the doping device 50*b* shown in FIG. 15. The controller 230 and a nozzle assembly 232 can be mounted to the bottom plate 208. The nozzle assembly 232 can include one or more nozzles 80 for delivering a spray pattern of fluid to the threads 120 and the should 49 of the box end 44 of the tubular 40, for a wide range of tubular sizes. For example, the size of tubulars 40 can include, but not limited to, 2⅜", 2⅞", 3½", 4", 4½", 5", 5½", 6⅝", 7", 7⅝", 8⅝", 8⅝", 9⅝", 10¾", 11¾", 13⅜", 16", 18⅝", and 20" diameter tubing. The nozzles 80 of the nozzle assembly 232 are oriented to direct the fluid spray axially down and radially out from the center axis 106, as is described in more detail below.

Figure 17:
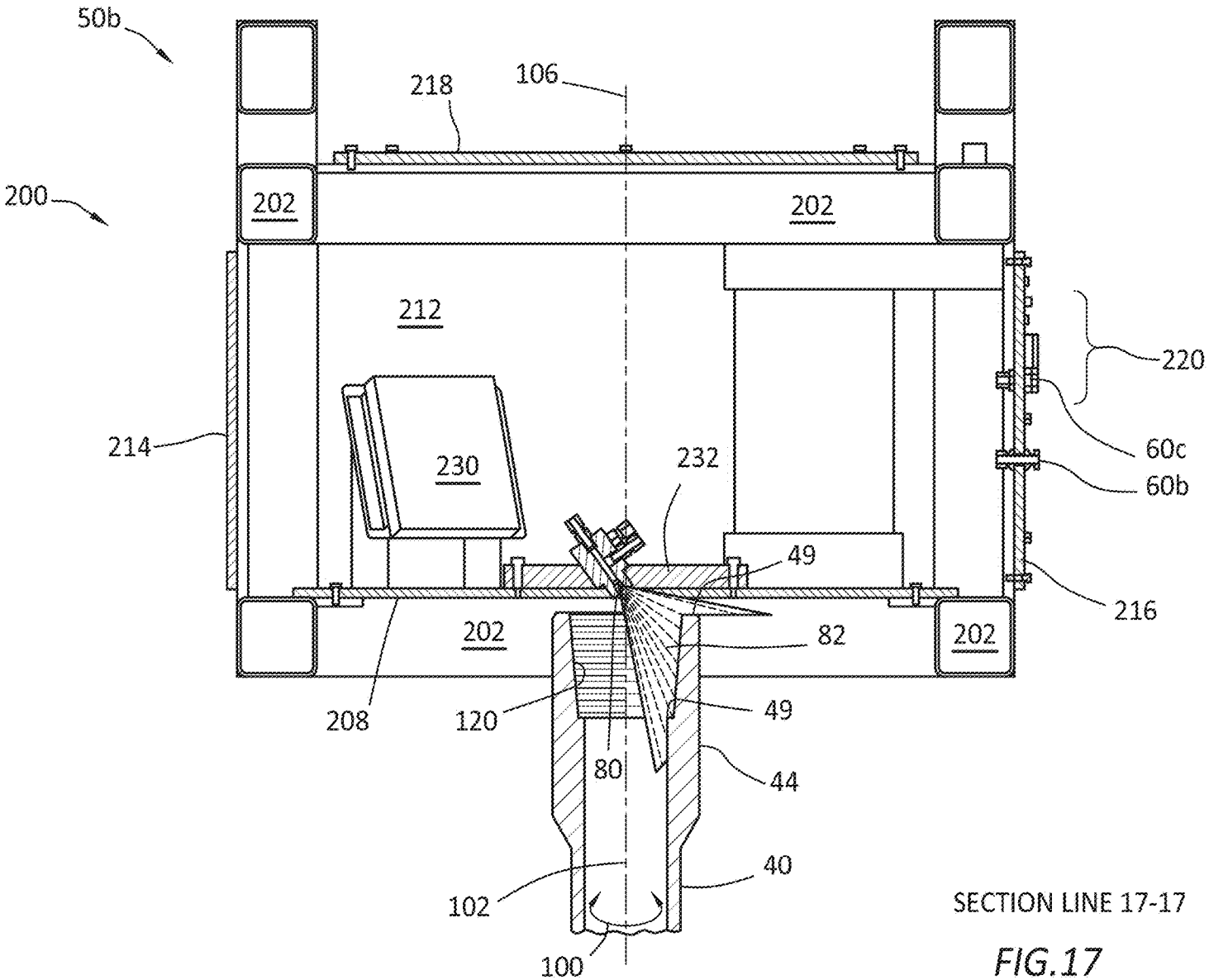
FIG. 17 is a partial cross-sectional view along cross section line 17-17 of the doping device shown in FIG. 15 with a small box end of a tubular proximate the doping device, in accordance to certain embodiments.
Figure 18:
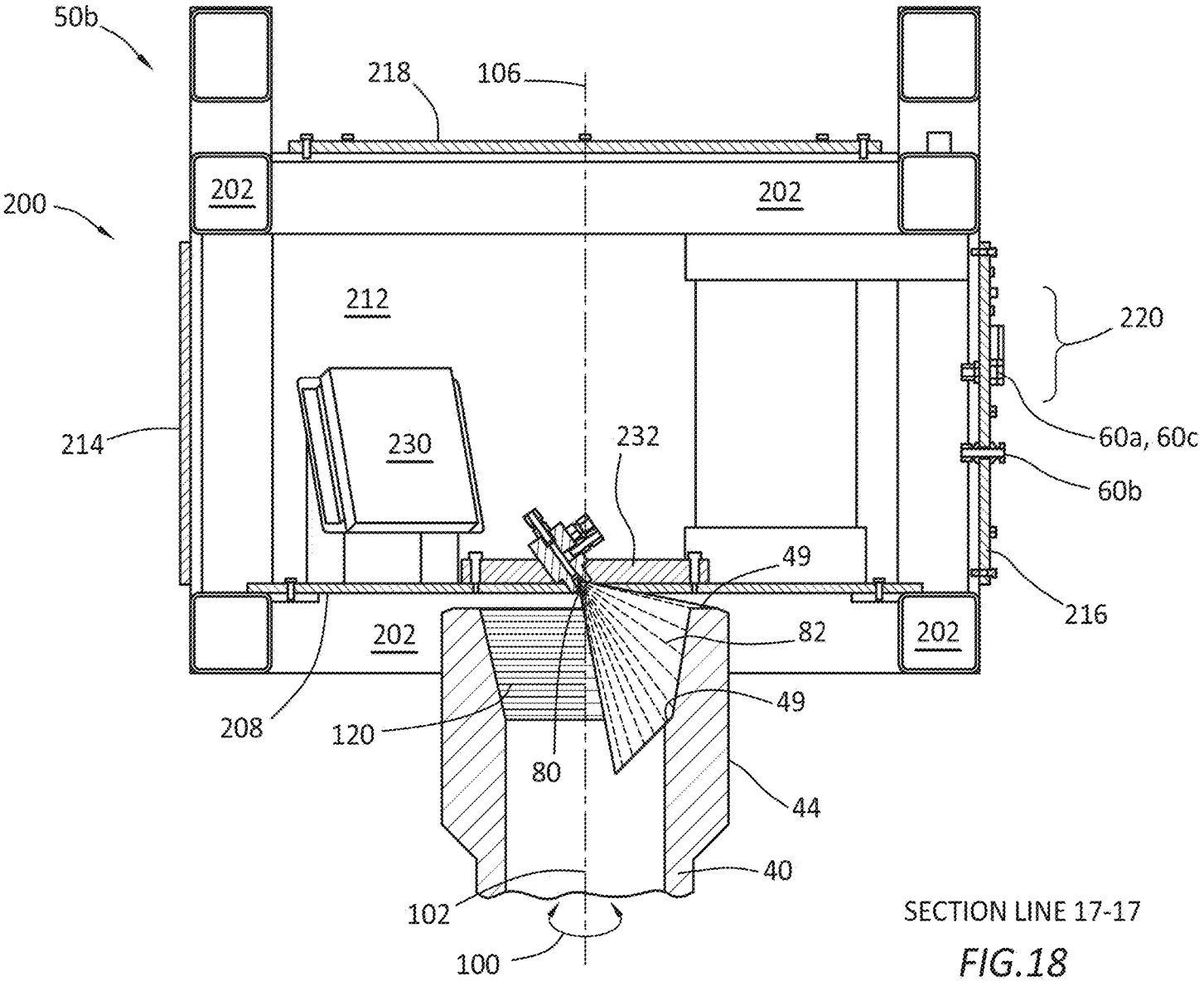
FIG. 18 is a partial cross-sectional view along cross section line 17-17 of the doping device shown in FIG. 15 with a large box end of a tubular proximate the doping device, in accordance to certain embodiments.

FIG. 17 is a partial cross-sectional view along cross section line 17-17 of the doping device 50*b* shown in FIG. 15 with a small box end 44 of a tubular 40 proximate the doping device 50*b*. FIG. 18 is a partial cross-sectional view along cross section line 17-17 of the doping device 50*b* shown in FIG. 15 with a large box end 44 of a tubular 40 proximate the doping device 50*b*. As can be seen from this views, the nozzle(s) 80 in the nozzle assembly 232 can be angled relative to the central axis 106, such that the nozzle(s) 80 can produce a fluid spray pattern 82 that is directed radially outward from the center axis 106 and axially down relative to the axis 106. With the angled orientation of the nozzle(s) 80, the fluid spray can cover the threads 120 as well as the shoulders 49 with the fluid for the various sizes of tubulars 40.

The controller 56 (possibly in cooperation with the controller 230) can control the pipe handler 20 to present the box end 44 proximate the doping device 50*b* such that the box end 44 is slightly spaced away from the cover plate 208. The pipe handler 20 can align This space allows the spray pattern 82 to reach both the shoulders 49 and the internal threads 120 of the box end 44. The angle of the nozzle(s) 80 can be adjusted as needed to provide the broadest coverage for the largest number of tubular sizes. In FIG. 17, the angled nozzle(s) 80 can produce a spray pattern 82 that covers the shoulders 49 at one end of the threads 120 with some overspray released through a space between the box end 44 and the cover plate 208. The fluid spray pattern 82 can also cover all of the internal threads 120 as well as a shoulders 49 at an opposite end of the threads 120 with some overspray onto an internal surface of the tubular 40. This wide fluid spray pattern 82 from the nozzle(s) 80 can ensure that the shoulders 49 and the threads 120 of the box end 44 are contacted by the fluid.

A center longitudinal axis 102 of the tubular 40 can be substantially aligned and/or substantially parallel to a center axis 106 of the doping device 50*b*. However, the longitudinal axis 102 and the center axis 106 are not required to be aligned or substantially parallel to each other. It is understood, that the doping device 50*b* can still clean the threads 120 and shoulders 49 and apply dope to the threads 120 and the shoulders 49 with the longitudinal axis 102 and the center axis 106 being somewhat out of alignment and not necessarily in parallel with each other. However, any misalignment or lack of parallelism between the axes 102, 106 must not prevent distribution of the fluids to the threads 120 and shoulders 49 by the spray pattern from the nozzle(s) 80.

With the box end 44 positioned proximate the cover plate 208, the controller 56 can control the pipe handler 20 to begin rotating the box end 44 (arrows 100). As the box end 44 is rotated, the nozzle(s) 80 can be controlled to deliver pressurized fluid as a fluid spray pattern 82 to impact the threads 120 and the shoulders 49 to clean them, dry them, and apply a layer of dope to them. The excess fluid can drain down the inside of the tubular 40 (e.g. overspray below threads 120 and lower shoulder 49) or be dispersed into the environment (e.g. overspray above threads 120 and upper shoulder 49). In this configuration of the doping device 50*b*, there is not a portion of the enclosure that catches the overspray released above the upper shoulder 49, which in some cases may be desirable. By dispersing the overspray into the surrounding environment external to the box end 44, the atomized fluid overspray can be carried away from the doping device 50*b* without collecting in pockets of fluid and later dropping the collected fluid from the doping device 50*b* when the fluid collection can no longer be help by the doping device 50*b*. However, the doping device 50*b* can be configured to collect the overspray fluid, if desired.

In general, the doping process for a box end 44 of a tubular 40 can begin with the nozzle(s) 80 producing a fluid spray pattern 82 of pressurized water that impinges the threads 120 and the shoulders 49 to clean the threads 120 and the shoulders 49 of old dope, debris, or other contaminants. When the threads 120 and the shoulders 49 are cleaned, the nozzle(s) can be controlled to produce a fluid spray pattern 82 of pressurized air to dry the threads 120 and the shoulders 49 of any residual water from the cleaning process. Once the threads 120 and the shoulders 49 are dried, then the nozzle(s) 80 can produce a fluid spray pattern 82 of an air/dope fluid mixture 88 that can deposit a layer of dope 86 onto the threads 120 and the shoulders 49. The thickness of the layer of dope deposited on the threads 120 and the shoulders 49 can be affected and controlled by several variables.

The variables that determine the thickness of dope applied to the threads 120 and shoulders 49 can be: 1) the rotational speed (RPMs) of the tubular 40 during the application of the dope through the nozzle 80, 2) the nozzle 80 selected for the doping device 50*b*, 3) the pressure of the dope flowing through the nozzle 80, 4) the dope selected, and 5) the duration of application of the dope to the threads 120 and shoulders 49. The controller 56 can control the duration of application of the dope and the rotational speed of the tubular 40. The controller 56 can also control the pressure of the dope if the dope storage provides a controllable pressure capability that can be controlled by the controller 56. The controller 56 can use the specifications of a selected nozzle 80, the specifications of the selected dope, and the pressure of the selected dope to calculate and control the tubular rotational speed and the duration of the application of the dope. By controlling these variables, via operators or the controller 56, the thickness of dope applied to the threads 120 and shoulders 49 on a box end 44 of a tubular 40 can be tailored to achieve the desired result of applying a desired thickness of dope to the threads 120 and the shoulders 49 of the box end 44.

As seen in FIG. 18, even larger tubulars 40 with correspondingly larger box ends 44 can have a desired thickness of dope applied to the threads 120 and the shoulders 49 of the box end 44 by the same doping device 50*b* with the nozzle(s) 80 at the same angled orientation as used in the configuration of FIG. 17.

It should be understood that both the pin and box ends 42, 44 of the tubular 40 can be cleaned and doped by the respective doping device 50*a*, 50*b* as the tubular is being routed to the well center for attachment to a tubular string 46. Alternatively, or in addition to, both the pin and box ends 42, 44 of the tubular 40 can be cleaned and doped by the respective doping device 50*a*, 50*b* as the tubular is being routed from the well center after being detached from a tubular string 46 and being in route to a tubular storage (vertical, inclined, horizontal, etc.). It should also be understood that the controller 56 can cause one or both of the pin or box ends 42, 44 of the tubular 40 to be cleaned and doped as described above at any point in a subterranean operation as is desired.

VARIOUS EMBODIMENTS

Embodiment 1. A system for conducting a subterranean operation, the system comprising:

a doping device configured to apply a fluid to a portion of a tubular, wherein the doping device forms a layer of the fluid on the portion of the tubular, with the layer having an average thickness measured over an area of the layer, with the area being at least 25% of a circumference of the portion of the tubular and along an axial length of at least 10 mm of the portion of the tubular.

Embodiment 2. The system of embodiment 1, wherein the tubular is one of a pipe segment, a pipe stand, a pipe stub, a casing segment, a casing stand, and a tubular stand.

Embodiment 3. The system of embodiment 1, wherein the tubular is one of various tubular sizes, and wherein the doping device is configured to accept and dope the threads of each of the various tubular sizes.

Embodiment 4. The system of embodiment 1, wherein the size of the tubular is selected from the group consisting of 2⅜", 2⅞", 3½", 4", 4½", 5", 5½", 6⅝", 7", 7⅝", 8⅝", 8⅝", 9⅝", 10¾", 11¾", 13⅜", 16", 18⅝", and 20" diameter tubing.

Embodiment 5. The system of embodiment 1, wherein thickness variations of the layer within the area are less than 20% of the average thickness of the layer across the area.

Embodiment 6. The system of embodiment 5, wherein the average thickness of the layer across the area is less than 3 mm.

Embodiment 7. The system of embodiment 6, wherein the average thickness of the layer across the area is less than 2.5 mm, or less than 2.0 mm, or less than 1.5 mm, or less than 1.0 mm, or less than 0.5 mm, or less than 0.4 mm, or less than 0.3 mm, or less than 0.2 mm, or less than 0.15 mm, or less than 0.12 mm.

Embodiment 8. The system of embodiment 1, wherein the area is at least 50%, or at least 75%, or 100% of the circumference of the portion of the tubular.

Embodiment 9. The system of embodiment 1, the doping device further comprising:

a housing mounted to a rig; and a nozzle mounted to the housing, the nozzle being directed radially toward the threads when the threads are positioned within the housing.

Embodiment 10. The system of embodiment 9, wherein the nozzle comprises a plurality of nozzles, and the plurality of nozzles are spaced circumferentially around the housing, and wherein the plurality of nozzles is directed radially toward the threads when the threads are positioned within the housing.

Embodiment 11. The system of embodiment 9, further comprising a pipe handler configured to manipulate the tubular such that the threads are positioned within the housing.

Embodiment 12. The system of embodiment 9, further comprising a rig controller, configured to control the doping device that applies dope to the tubular and a pipe handler that manipulates the tubular such that the threads are positioned within the housing.

Embodiment 13. The system of any one of embodiments 7 and 8, wherein the rig controller or the pipe handler selectively controls flow of a fluid through the nozzle by selective actuation of at least one valve between open and closed configurations via control of a respective actuator of the at least one valve, wherein the fluid is forced through the nozzle when the at least one valve is actuated to the open configuration, and wherein fluid is restricted from flowing through the nozzle when the at least one valve is actuated to the closed configuration.

Embodiment 14. The system of embodiment 13, wherein the pipe handler rotates the tubular relative to the nozzle, when the at least one valve is actuated to the open configuration and the fluid is flowing through the nozzle, which produces a fluid spray pattern of the fluid as the fluid exits the nozzle and the fluid spray pattern impinges the threads.

Embodiment 15. The system of embodiment 13, wherein the fluid that is supplied to the nozzle at a pressure of less than 200 bar (2901 psi) and greater than 2 bar (29 psi), and when the fluid exits the nozzle the fluid forms a spray pattern.

Embodiment 16. The system of embodiment 13, wherein the fluid is a mixture of air and the dope, and wherein the rig controller or pipe handler adjusts at least one of a rotational speed of the tubular, a pressure applied to the fluid, or a duration of application of the dope to control the thickness of the dope applied to the threads from the nozzle.

Embodiment 17. The system of embodiment 16, wherein the dope under pressure is impinged by air under pressure to produce the mixture, and to enhance atomization of the dope that exits the nozzle as a mist to be deposited onto the threads when the threads are positioned within the housing.

Embodiment 18. The system of embodiment 13, wherein the fluid is selected from the group consisting of air, water, dope, and combinations thereof.

Embodiment 19. The system of embodiment 18, wherein the nozzle comprises a plurality of nozzles, with a first nozzle of the plurality of nozzles configured to spray the air or the water on the threads when the threads are positioned within the housing, and with a second nozzle of the plurality of nozzles configured to deliver a mixture of the air and the dope to the threads when the threads are positioned within the housing.

Embodiment 20. The system of embodiment 19, wherein a third nozzle of the plurality of nozzles is configured to spray the water on the threads when the threads are positioned within the housing, and wherein the first nozzle is configured to spray the air on the threads when the threads are positioned within the housing.

Embodiment 21. The system of embodiment 9, wherein the threads are on an exterior surface of a pin end of the tubular, and wherein the nozzle is directed radially inward toward the threads of the pin end when the pin end is positioned within the housing.

Embodiment 22. The system of embodiment 9, wherein the threads are on an interior surface of a box end of the tubular, and wherein the nozzle is directed radially outward toward the threads of the box end when the box end is positioned within the housing.

Embodiment 23. A system for doping threads of a tubular in a subterranean operation, the system comprising:

a doping device configured to apply fluid to the threads of the tubular as the tubular is rotated relative to the doping device, the doping device comprising a nozzle operated at an elevated pressure which forces the fluid through the nozzle and sprays the fluid on the threads of the tubular, wherein the elevated pressure is less than 200 bar (2901 psi) and greater than 2 bar (29 psi).

Embodiment 24. The system of embodiment 23, wherein the elevated pressure is less than 150 bar (2176 psi) and greater than 2 bar (29 psi), or less than 140 bar (2031 psi) and greater than 3 bar (44 psi), or less than 140 bar (2031 psi) and greater than 3.85 bar (56 psi), or less than 140 bar (2031 psi) and greater than 4 bar (58 psi), or less than 140 bar (2031 psi) and greater than 5 bar (73 psi), or less than 140 bar (2031 psi) and greater than 8 bar (116 psi), or less than 140 bar (2031 psi) and greater than 10 bar (145 psi), or less than 135 bar (2031 psi) and greater than 110 bar (1595 psi), or less than 130 bar (1885 psi) and greater than 120 bar (1740 psi).

Embodiment 25. The system of embodiment 23, wherein the elevated pressure is less than 130 bar (1885 psi) and greater than 120 bar (1740 psi).

Embodiment 26. The system of embodiment 23, wherein the doping device comprises:

a housing mounted to a rig; and the nozzle mounted to the housing, with the nozzle being directed radially toward the threads when the threads are positioned within the housing.

Embodiment 27. The system of embodiment 26, wherein the nozzle comprises a plurality of nozzles, and the plurality of nozzles are spaced circumferentially around the housing, and wherein the plurality of nozzles is directed radially toward the threads when the threads are positioned within the housing.

Embodiment 28. The system of embodiment 26, further comprising a pipe handler configured to manipulate the tubular such that the threads are positioned within the housing.

Embodiment 29. The system of embodiment 28, wherein the pipe handler or a rig controller selectively controls flow of a fluid through the nozzle by selective actuation of at least one valve between open and closed configurations via control of a respective actuator of the at least one valve, wherein the fluid is forced through the nozzle when the at least one valve is actuated to the open configuration, and wherein fluid is restricted from flowing through the nozzle when the at least one valve is actuated to the closed configuration.

Embodiment 30. The system of embodiment 29, wherein the pipe handler rotates the tubular relative to the nozzle when the at least one valve is actuated to the open configuration and the fluid flows through the nozzle, which produces a fluid spray pattern of the fluid as the fluid exits the nozzle and the fluid spray pattern impinges the threads when the threads are within the housing.

Embodiment 31. The system of embodiment 26, wherein the fluid is a mixture of air and dope, and wherein application of the fluid forms an average thickness of less than 3 mm of the dope on the threads.

Embodiment 32. The system of embodiment 31, wherein a pipe handler adjusts a rotational speed of the tubular to control a thickness of the dope applied to the threads from the nozzle.

Embodiment 33. The system of embodiment 32, wherein the dope under pressure is impinged by air under pressure to produce the mixture, and to enhance atomization of the dope that exits the nozzle to form a fluid spray pattern, the dope being deposited by the fluid spray pattern on the threads when the threads are positioned within the housing.

Embodiment 34. The system of embodiment 26, wherein the fluid is selected from the group consisting of air, water, dope, and combinations thereof.

Embodiment 35. The system of embodiment 34, wherein the nozzle comprises a plurality of nozzles, with a first nozzle of the plurality of nozzles configured to apply water to the threads when the threads are positioned within the housing, and wherein the application of the water cleans the threads, and with a second nozzle configured to apply air to the threads when the threads are positioned within the housing, and wherein the application of the air dries the threads.

Embodiment 36. The system of embodiment 35, further comprising a third nozzle configured to apply a mixture of dope and air to the threads when the threads are positioned within the housing, and wherein the application of the mixture applies dope to the threads.

Embodiment 37. A method for conducting a subterranean operation, the method comprising:

mounting a doping device with a plurality of nozzles to a rig, such that the plurality of nozzles is rotationally fixed to the rig;

rotating, via a pipe handler, a tubular relative to the plurality of nozzles and the rig; and spraying a fluid on threads of an end of the tubular while the tubular is rotating.

Embodiment 38. The method of embodiment 37, wherein the fluid is an air/dope mixture, and wherein the spraying further comprises forming a layer of dope on a portion of the threads, with the layer having an average thickness measured over an area of the layer, with the area being at least 25% of a circumference of the portion of the threads and along an axial length of at least 10 mm of the portion of the threads.

Embodiment 39. The method of embodiment 38, wherein the average thickness of the layer across the area is less than 3 mm, or less than 2.5 mm, or less than 2.0 mm, or less than 1.5 mm, or less than 1.0 mm, or less than 0.5 mm.

Embodiment 40. The method of embodiment 38, further comprising selectively enabling one of the plurality of nozzles, via the pipe handler or a rig controller, to spray the fluid on the threads.

Embodiment 41. The method of embodiment 37, wherein the doping device comprises a housing with the plurality of nozzles mounted to the housing, the method further comprising:

positioning, via the pipe handler, the end of the tubular into the housing;

pressurizing the fluid to a pressure of less than 200 bar (2901 psi) and greater than 2 bar (29 psi); and spraying the fluid from at least one of the plurality of nozzles on the threads when the at least one of the plurality of nozzles is enabled.

Embodiment 42. The method of embodiment 41, wherein the fluid is water, and the spraying the fluid further comprises cleaning the threads via impingement of the water on the threads.

Embodiment 43. The method of embodiment 41, wherein the fluid is air, and the spraying the fluid further comprises drying the threads via impingement of the air on the threads.

Embodiment 44. The method of embodiment 41, wherein the fluid is a mixture of dope and air, and the spraying the fluid further comprises forming a layer of dope on a portion of the threads, with the layer having an average thickness measured over an area of the layer, with the area being at least 25% of a circumference of the portion of the threads and along an axial length of at least 10 mm of the portion of the threads, and the average thickness being less than 3 mm.

Embodiment 45. The method of embodiment 41, wherein each one of the plurality of nozzles has a respective valve that is actuated between open and closed configurations, and the spraying the fluid further comprises:

controlling, via the pipe handler, the respective valve of one or more of the plurality of nozzles;

actuating the respective valve of the one or more of the plurality of nozzles to the open configuration in response to the controlling; and enabling the spraying of the fluid in response to the actuating.

Embodiment 46. The method of embodiment 45, wherein a same fluid or a different fluid is supplied to the respective valve of the one or more of the plurality of nozzles.

Embodiment 47. The method of embodiment 46, wherein the fluid is selected from the group consisting of air, water, dope, and combinations thereof.

Embodiment 48. A system for conducting a subterranean operation, the system comprising:

a rig; and a doping device, the doping device comprising:

a housing rotationally fixed to the rig; and a nozzle rotationally fixed to the housing, the nozzle being directed radially toward a portion of a tubular when the portion of the tubular is positioned proximate the housing.

Embodiment 49. The system of embodiment 48, wherein the nozzle is configured to apply a dope to the portion of the tubular, and wherein the nozzle deposits a layer of the dope on the portion of the tubular while the tubular is being rotated.

Embodiment 50. The system of embodiment 49, wherein the layer has an average thickness measured over an area of the layer, with the area being at least 50% of a circumference of the portion of the tubular and along an axial length of at least 10 mm of the portion of the tubular, wherein thickness variations of the layer within the area are less than 20% of the average thickness of the layer across the area, and wherein the average thickness of the layer across the area is less than 3 mm.

Embodiment 51. The system of embodiment 48, wherein the portion of the tubular comprises threads and at least one connection shoulder of a pin end or a box end of the tubular.

Embodiment 52. The system of embodiment 48, wherein the doping device is configured to be fixedly mounted to the rig at any orientation between and including 0 "zero" degrees and 180 degrees relative to a rig floor of the rig.

Embodiment 53. The system of embodiment 48, wherein the doping device is configured to apply a fluid to the portion of the tubular, wherein a size of the tubular is in a range from 2⅜" to 20" diameter tubing.

Embodiment 54. The system of embodiment 48, wherein a fluid is selectively supplied to the nozzle via one or more actuators and the nozzle is configured to produce a spray pattern when the one or more actuators is actuated by a rig controller, and wherein the spray pattern forms a plane that is substantially parallel to a central axis of the doping device.

Embodiment 55. The system of embodiment 54, wherein the fluid is selected from a group consisting of 1) water that cleans old dope, debris, or other contaminants from the portion of the tubular, 2) air that dries the portion of the tubular, or 3) a mixture of air and new dope that deposits the new dope onto the portion of the tubular.

Embodiment 56. The system of embodiment 54, wherein the fluid is a mixture of air and dope, and wherein the rig controller controls at least one of a rotational speed of the tubular, a pressure applied to the fluid, or a duration of application of the dope to control a thickness of the dope applied to the portion of the tubular from the nozzle.

Embodiment 57. The system of embodiment 56, wherein the dope under pressure is impinged by air under pressure to produce the mixture and to enhance atomization of the dope that exits the nozzle as a mist to form the spray pattern.

Embodiment 58. The system of embodiment 48, further comprising a pipe handler, wherein the pipe handler is configured to position the portion of the tubular within the housing, wherein the nozzle is directed radially inward toward the portion of the tubular and a central axis of the doping device, and wherein the portion of the tubular comprises threads and at least one connection shoulder on a pin end of the tubular.

Embodiment 59. The system of embodiment 48, further comprising a pipe handler, wherein the pipe handler is configured to position the portion of the tubular proximate a bottom cover plate of the housing, the bottom cover plate being perpendicular to a central axis of the doping device, and the nozzle being mounted to the bottom cover plate, wherein the nozzle is directed radially outward from the central axis of the doping device and axially away from the bottom cover plate toward the portion of the tubular, and wherein the portion of the tubular comprises internal threads and at least one internal connection shoulder in a box end of the tubular.

While the present disclosure may be susceptible to various modifications and alternative forms, specific embodiments have been shown by way of example in the drawings and tables and have been described in detail herein. However, it should be understood that the embodiments are not intended to be limited to the particular forms disclosed. Rather, the disclosure is to cover all modifications, equivalents, and alternatives falling within the spirit and scope of the disclosure as defined by the following appended claims. Further, although individual embodiments are discussed herein, the disclosure is intended to cover all combinations of these embodiments.

The invention claimed is:

1. A system for conducting a subterranean operation, the system comprising:

a rig; and a doping device, the doping device comprising:

a housing rotationally fixed to the rig; and a nozzle rotationally fixed to the housing, the nozzle being directed radially toward a portion of a tubular when the portion of the tubular is positioned proximate the housing, wherein a center axis of the doping device substantially aligns with a center axis of the tubular when the portion of the tubular is positioned proximate the housing, wherein the center axis of the doping device is spaced away from a well center and a mouse-hole of the rig, wherein the pipe handler is configured to position the portion of the tubular proximate a bottom cover plate of the housing, the bottom cover plate being perpendicular to a central axis of the doping device, and the nozzle being mounted to the bottom cover plate, wherein the nozzle is directed radially outward from the central axis of the doping device and axially away from the bottom cover plate toward the portion of the tubular, and wherein the portion of the tubular comprises internal threads and at least one internal connection shoulder in a box end of the tubular.

* * * * *